US005258747A

United States Patent [19]

Oda et al.

[11] Patent Number: 5,258,747

[45] Date of Patent: Nov. 2, 1993

[54] COLOR IMAGE DISPLAYING SYSTEM AND METHOD THEREOF

[75] Inventors: Toshiyuki Oda, Kawasaki; Koji Kawakami; Hajime Fujiya, both of Chigasaki, all of Japan

[73] Assignee: Hitachi, Ltd., Tokyo, Japan

[21] Appl. No.: 941,965

[22] Filed: Sep. 8, 1992

[30] Foreign Application Priority Data

Sep. 30, 1991 [JP] Japan ..... 3-276159

[51] Int. Cl.[5] ..... G09G 1/28

[52] U.S. Cl. ..... 345/153; 358/182; 358/183; 345/115

[58] Field of Search ..... 340/703, 721, 747, 799; 358/22, 182, 183; 395/131, 133, 134, 135, 164, 166

[56] References Cited

U.S. PATENT DOCUMENTS 4,818,979 4/1989 Manson ..... 340/703
4,868,552 9/1989 Chang ..... 340/721
4,894,653 1/1990 Frankenbach ..... 340/799
5,065,231 11/1991 Greaves et al. ..... 358/183

*Primary Examiner*—Ulysses Weldon
*Assistant Examiner*—Matthew Luu
*Attorney, Agent, or Firm*—Antonelli, Terry, Stout & Kraus

[57] ABSTRACT

A color image displaying method in which n of independent combinations of bit maps and CLUTs are prepared from data of n (n being a natural number) of independent original images, composite bit maps are prepared respectively by composing color codes ones of the pixels of the n of bit map at the same display position, a composite CLUT is prepared by composing the n of CLUTs, the composite bit map is displayed with use of the composite CLUT, whereby such image effect displays as fade-in, fade-out, cross fade, and glowing can be realized with respect to the plurality of images while preventing the increase of a bit map capacity and a display circuit size.

26 Claims, 13 Drawing Sheets

FIG. 2

| | COLOR CODE | R | G | B |
|---|---|---|---|---|
| CLUT FOR IMAGE A | Aa | 128 | 32 | 0 |
| | Ab | 16 | 128 | 64 |
| CLUT FOR IMAGE B | Ba | 64 | 0 | 16 |
| | Bb | 128 | 32 | 128 |

FIG. 3

| TIME t | COLOR DATA Xa ( t ) | | |
|---|---|---|---|
| | R | G | B |
| 0 | 128 | 32 | 0 |
| 1 | 120 | 28 | 2 |
| 2 | 112 | 24 | 4 |
| 3 | 104 | 20 | 6 |
| 4 | 96 | 16 | 8 |
| 5 | 88 | 12 | 10 |
| 6 | 80 | 8 | 12 |
| 7 | 72 | 4 | 14 |
| 8 | 64 | 0 | 16 |

FIG. 6

201

| COLOR CODE | ARITHMETIC OPERATION | | |
|---|---|---|---|
| | R | G | B |
| 0 | 80 | 20 | 00 |
| 1 | 10 | 80 | 40 |
| ⋮ | ⋮ | ⋮ | ⋮ |
| F | FF | FF | FF |

CLUT A
16 COLORS ( 4BITS )

211

| COLOR CODE | COLOR DATA | | |
|---|---|---|---|
| | R | G | B |
| 0 | 40 | 00 | 10 |
| 1 | 80 | 20 | 80 |
| ⋮ | ⋮ | ⋮ | ⋮ |
| F | 00 | 00 | 00 |

CLUT B
16 COLORS ( 4BITS )

221

| COLOR CODE | COLOR DATA | | |
|---|---|---|---|
| | R | G | B |
| 00 | 80 | 20 | 00 |
| 01 | 80 | 20 | 00 |
| ⋮ | ⋮ | ⋮ | ⋮ |
| 0F | 80 | 20 | 00 |
| 10 | 10 | 80 | 40 |
| 11 | 10 | 80 | 40 |
| ⋮ | ⋮ | ⋮ | ⋮ |
| 1F | 10 | 80 | 40 |
| ⋮ | ⋮ | ⋮ | ⋮ |
| F0 | FF | FF | FF |
| F1 | FF | FF | FF |
| ⋮ | ⋮ | ⋮ | ⋮ |
| FF | FF | FF | FF |

CLUT X
256 COLORS ( 8BITS )

FIG. 7

201

| COLOR CODE | COLOR DATA | | |
|---|---|---|---|
| | R | G | B |
| 0 | 80 | 20 | 00 |
| 1 | 10 | 80 | 40 |
| ⋮ | ⋮ | ⋮ | ⋮ |
| F | FF | FF | FF |

CLUT A
16 COLORS ( 4BITS )

211

| COLOR CODE | COLOR DATA | | |
|---|---|---|---|
| | R | G | B |
| 0 | 40 | 00 | 10 |
| 1 | 80 | 20 | 80 |
| ⋮ | ⋮ | ⋮ | ⋮ |
| F | 00 | 00 | 00 |

CLUT B
16 COLORS ( 4BITS )

221

| COLOR CODE | COLOR DATA | | |
|---|---|---|---|
| | R | G | B |
| 00 | 40 | 00 | 10 |
| 01 | 80 | 20 | 80 |
| ⋮ | ⋮ | ⋮ | ⋮ |
| 0F | 00 | 00 | 00 |
| 10 | 40 | 00 | 10 |
| 11 | 80 | 20 | 80 |
| ⋮ | ⋮ | ⋮ | ⋮ |
| 1F | 00 | 00 | 00 |
| ⋮ | ⋮ | ⋮ | ⋮ |
| F0 | 40 | 00 | 10 |
| F1 | 80 | 20 | 80 |
| ⋮ | ⋮ | ⋮ | ⋮ |
| FF | 00 | 00 | 00 |

CLUT X
256 COLORS ( 8BITS )

COLOR IMAGE DISPLAYING SYSTEM AND METHOD THEREOF

BACKGROUND OF THE INVENTION

The present invention generally relates to display of a color image with use of color look up tables (which will be referred to merely as the CLUTs, hereinafter) and, more particularly, to a color image displaying method for switching a plurality of images to be displayed.

In a color image displaying method in digital processing, the luminance levels of each of three primitive colors of R (red), G (green) and B (blue) are expressed in terms of $2^{3n}$ of n-bit color data. In such a method that one color data is held for each pixel in a display image for color display, a display memory is required to have a capacity of 3n bits per pixel.

Meanwhile, in a color display method using a CLUT, a data per pixel is expressed in terms of an m-bit color code and the color code is converted into the luminance levels of the R, G and B to express $2^m$ of colors. In this display method, since a display image is formed through the CLUT and a bit map made up of the color codes associated with the pixels and the amount of data in the bit map is proportional to m, the amount of necessary image data can be reduced. Further, by modifying the CLUT for converting the color codes into the luminance levels of the R, G and B, the display color can be easily modified even with use of the same bit map data.

There has been proposed a method for simultaneously displaying a plurality of images with a limited number of displayable colors, wherein color code data are divided into a plurality of blocks, one image is allocated to each block, and CLUTs are operated on every block basis to realize the simultaneous display of the plurality of images.

An example of such display method is disclosed in Japanese Patent Application Hei 3-61995.

In the prior art display method, the color code data are divided into a plurality of blocks with respect to its depth direction, one image is allocated to each block, and the CLUTs are switched to display the image seemingly differently with respect to part of the bit map regions.

However, since the plurality of images are displayed as overlapped with each other, one of CLUT numbers of each of the CLUTs for the images must has a transparent color.

Further, since the plurality of images are displayed as always overlapped with each other, the method has a problem that such image effects as fade-in, fade-out, cross fade and glowing cannot be obtained.

Furthermore, since the bit maps are composed on a display memory, this disadvantageously requires a special display circuit.

SUMMARY OF THE INVENTION

In view of the above problems in the prior art, it is an object of the present invention to provide a color image displaying method which can realize such image effect displays as fade-in, fade-out, cross fade, and glowing while preventing the increase of a bit map capacity and a display circuit size.

In accordance with the present invention, the above object is attained by preparing n of independent combinations of bit maps and CLUTs from data of n (n being a natural number) of independent original images, preparing a composite bit map respectively by composing color codes ones of the pixels of the n of bit map at the same display position, preparing a composite CLUT by composing the n of CLUTs, and displaying the composite bit map with use of the composite CLUT.

In the invention, the composite CLUT is made in the form of an n-dimensional color code array, the number of color codes corresponding to the number of the i-th elements (where i is a natural number below n) is higher than the number of color codes in the j-th CLUT, and a product of the color code numbers of the respective dimensions of the color code array is smaller than a limited CLUT color number.

Or, n (n being a natural number) of independent original image data are regarded as one original image data having 3n-dimensional color data, typical colors having 3n of color data are determined with respect to one color code, bit maps are correspondingly prepared, 3 of the color data are extracted from the color codes of the typical colors to prepare a CLUT, and the bit map is displayed through the CLUT.

A first bit map and a first CLUT made up of c (c being a natural number below the CLUT limited color number) of color codes are prepared from first original image data, second original image data are prepared, a second CLUT is prepared from a c of histograms of the second original image data prepared for the c of color codes of the first bit map at the same display positions as the second original image data, the second CLUT is used to prepare a second bit map, and mixed color data of the first and second CLUTs with respect to the second bit map are used for display.

Further, for enhancing an visual effect, one period for display of one bit map and CLUT prepared from one original image data and the other are provided before and after the image effect respectively.

Since the CLUTs corresponding to the plurality of images are effectively selected and allocated as the closest color codes to create the composite bit map, the quality of the image to be displayed can be prevented from being deteriorated. When the color data of one image are allocated as the color data associated with the color codes, the composite bit map causes the one image to be displayed.

Further, since a mixture of the color data of the plurality of images at a predetermined ratio is allocated as the CLUT color data, the bit maps cause the plurality of images to be displayed as overlapped with each other. In addition, when the CLUTs obtained by setting the mixture ratio of the color data stepwise are continuously switched, cross fade switching can be realized with two images overlapped with each other.

Furthermore, in a display unit having 3 planes of R (red), G (green) and B (blue) each having a CLUT, when bit maps obtained by composing from a plurality of images are stored with respect to each plane and the CLUTs are switched, one or some of the plurality of images is or are displayed as overlapped with each other.

BRIEF DESCRIPTION OF THE DRAWINGS

FIG. 2 shows, as an example, specific values of color data associated with color codes Aa, Ab, Ba and Bb of a bit map for original images A 100 and B 110 in FIG. 1;

FIG. 3 shows transition of cross fade switching of color data Xa(t) associated with a color code ABa in a composite image X 120 in FIG. 1;

FIG. 6 shows diagrams for explaining the contents of CLUTs in FIG. 5;

FIG. 7 shows diagrams for explaining the contents of the CLUTs in FIG. 5;

DESCRIPTION OF THE PREFERRED EMBODIMENTS

An embodiment of the present invention will be detailed with reference to the accompanying drawings.

Figure 1:
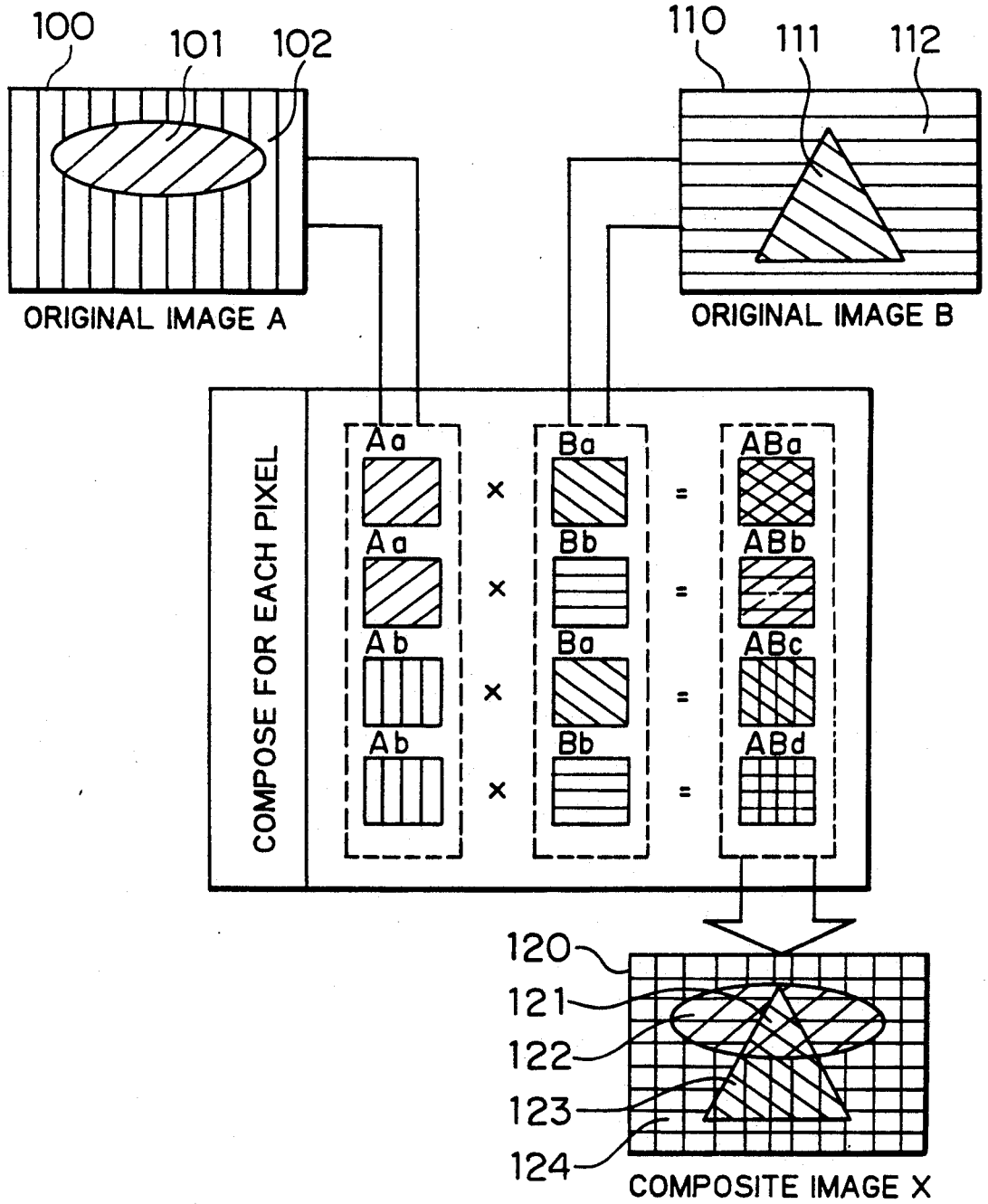
FIG. 1 is a diagram for explaining the principle of how to create a composite image from two sorts of independent images according to a color image displaying method of one embodiment of the present invention.

Referring first to FIG. 1, there is shown a principle of how to generate a composite image from two sorts of independent images according to a color image displaying method of an embodiment of the present invention.

In FIG. 1, an original image A 100 comprises a monochromatic bit map region 101 made up of color code pixels Aa and another monochromatic bit map region 102 made up of color code pixels Ab; whereas another original image B 110 comprises a monochromatic bit map region 111 made up of color code pixels Ba and another monochromatic bit map region 112 made up of color code pixels Bb.

In the drawing, a composite image X 120, which is obtained by composing the original image A 100 and the original image B 110, comprises four monochromatic bit map regions 121, 122, 123 and 124.

The monochromatic bit map region 121, which corresponds to the composition of overlapped parts between the monochromatic bit map regions 101 and 111, comprises color code pixels ABa each corresponding to the composition of the color code pixels Aa and Ba.

The monochromatic bit map region 122, which corresponds to the composition of overlapped parts between the monochromatic bit map regions 101 and 112, comprises color code pixels ABb each corresponding to the composition of the color code pixels Aa and Bb.

The monochromatic bit map region 123, which corresponds to the composition of overlapped parts between the monochromatic bit map regions 102 and 111, comprises color code pixels ABc each corresponding to the composition of the color code pixels Ab and Ba.

The monochromatic bit map region 124, which corresponds to the composition of overlapped parts between the monochromatic bit map regions 102 and 112, comprises color code pixels ABd each corresponding to the composition of the color code pixels Ab and Bb.

In this way, the color code pixel making up each of the monochromatic bit map regions of the composite image X 120 is obtained by composing the two color codes making up the monochromatic bit map regions of the two original images. Accordingly, when color data corresponding to the color codes of the original image A 100 are used in the CLUT to convert the color codes making up the respective monochromatic bit map regions of the composite image X 120 into actual color data, the respective monochromatic bit map regions of the composite image X120 can be displayed with the same colors as the monochromatic bit map regions of the original image A 100. Conversely, when color data corresponding to the color codes of the original image B 110 are used in the CLUT, the respective monochromatic bit map regions of the composite image X120 can be displayed with the same colors as the monochromatic bit map regions of the original image B 110.

Explanation will next be made as to a method for performing cross fade switching operation between the two independent original images A 100 and B 110 on the basis of the image data shown in FIG. 1 and with use of the single composite image X 120. The cross fade changing will be explained in connection with an example where the cross fade switching is carried out from the original image A 100 to the original image B 110 through 8 stages of time transition t ($0 \leqq t \leqq 8$).

The cross fade switching is such a display system that two images are displayed as overlapped, during which one image component is decreased while the other is increased for gradual switching. The word 'image component' as used herein refers to such a color data as to be expressed in terms of the luminance levels of R, G and B of the pixels of the image.

When a luminance level b varies linearly from a luminance level x1 to a luminance level x2 through the time transition t ($0 \leqq t \leqq n$), a luminance level x(t) is expressed by the following equation (1).

$$x(t)=\{(x2-x1)/n\}\times t+x1 \quad (1)$$

It is now assumed that color data corresponding to color codes ABa, ABb, ABc and ABd making up the bit map of the composite image X 120 during the cross fade switching operation are represented by Xa(t), Xb(t), Xc(t) and Xd(t) (not shown). In other words, the monochromatic bit map regions 121, 122, 123 and 124 of the composite image X 120 are expressed in terms of the color data Xa(t), Xb(t), Xc(t) and Xd(t) respectively.

The specific values of the color data corresponding to the color codes Aa, Ab, Ba and Bb of the bit maps of the original images A 100 and B 110 are given in FIG. 2 as an example.

In the drawing, the color codes Aa and Ab form part of the CLUT of the original image A 100 and have color data values (R, G, B) of (128, 32, 0) and (16, 128, 64) respectively. The same holds true for the color codes Ba and Bb and therefore explanation there is omitted.

Accordingly, during the cross fade switching operation, when the color data Xa(t) of the color code ABa in the composite image X 120 is gradually transited from a color data value (R, G, B) of (128, 32, 0) for the color code Aa to a color data value (R, G, B) of (64, 0, 16) for the color code Ba, luminance levels XaR(t), XaG(t) and XaB(t) of the color data Xa(t) with respect to R, G and B are expressed by the following equations (2) to (4), as seen from the equation (1) and specific values of the color code Xa(t) are given in FIG. 3.

$$XaR(t) = -8t + 128 \quad (2)$$

$$XaG(t) = -4t + 32 \quad (3)$$

$$XaB(t) = 2t \quad (4)$$

Similarly, when the color code Xb(t), Xc(t) and Xd(t) of the color codes ABb, ABc and ABd in the composite image X 120 are gradually transited, the user can look at the composite image X 120 as if gradual transition is carried out from the original image A 100 to the original image B 110 as overlapped. In this way, when the image component is gradually changed with the time t, different images can be displayed through the cross fade switching.

Figure 4:
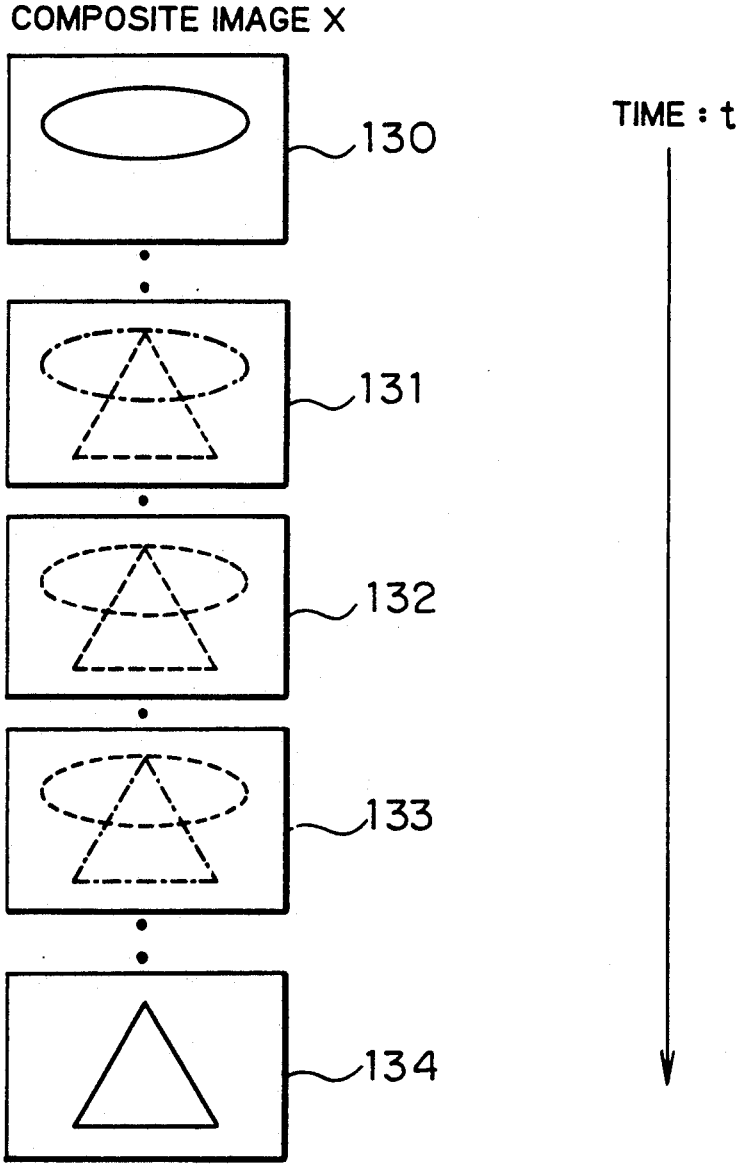
FIG. 4 shows transition of the composite image X 120 varying with time from the original image A 100 to the original image B 110.

FIG. 4 shows a transition the composite image X 120 is changed as the original image A 100 is changed to the original image B 100 with time t.

In FIG. 4, more specifically, reference numeral 130 denotes a state when the composite image X 120 shown in FIG. 1 starts the cross fade switching operation (stage 0), numeral 131 denotes a state corresponding to the second stage after starting the cross fade switching operation, 132 denotes a state corresponding to the fourth stage after starting the cross fade switching operation, 133 denotes a state corresponding to the sixth stage after starting the cross fade switching operation, and 134 denotes a state corresponding to the eighth stage after starting the cross fade switching operation. The first, third, fifth and seventh stages are not illustrated and omitted.

In the cross fade switching start time (stage 0), as clear from the equations 2 to 4 and FIGS. 2 and 3, since the color data Xa(0) to Xd(0) are all expressed only with the color components of the original image A 100, the user looks a displayed image 130 as if it is the original image A 100 itself.

Similarly, in the second stage after starting the cross fade switching operation, since the color data Xa(2) to Xd(2) correspond to an addition of 75% of the R, G and B luminance components of the original image A 100 to 25% of the R, G and B luminance components of the original image B 110, the user looks the state 131 of the composite image X 120 as if it is the original image B 110 in the original image A 100 as thinly overlapped therewith.

In the fourth stage after starting the cross fade switching operation, since the color data Xa(4) to Xd(4) correspond to an addition of 50% of the R, G and B luminance components of the original image A 100 to 50% of the R, G and B luminance components of the original image B 110, the user looks the state 132 of the composite image X 120 as if it is the original image A 100 overlapped with the original image B 110.

In the sixth stage after starting the cross fade switching operation, since the color data Xa(6) to Xd(6) correspond to an addition of 25% of the R, G and B luminance components of the original image A 100 to 75% of the R, G and B luminance components of the original image B 110, the user looks the state 132 of the composite image X 120 as if it is the original image A 100 in the original image B 110 as thinly overlapped therewith.

In the eighth stage after starting the cross fade switching operation, since the color data Xa(8) to Xd(8) are all expressed with only the color components of the original image B 110, the user looks the state 134 of the composite image X 120 as if it is the original image B 110 itself.

In this way, when the color data is varied with time t, the composite image X 120 can be subjected to the cross fade switching.

When it is desired to perform the cross fade switching from the original image A 100 to the original image B 110, one-stage transition enables simultaneous image switching. In this case, it is required to rewrite the color data of the color codes ABa, ABb, ABc and ABd from the color data of the color codes Aa, Aa, Ab and Ab to the color data of the color codes Ba, Bb, Ba and Bb.

When the original image A 100 comprises all one-color codes (that is, comprises a monochromatic bit map), cross fade switching of the original images A 100 and B 110 causes the original image B 110 to be as if it fades in on the screen. Therefore, when the color code Aa at the time of starting the cross fade switching operation is set to be Ab (i.e., monochromatic), fade-in display can be realized from the monochromatic Aa to the original image B 110 with use of the composite image X 120.

Fade-out, as in the fade-in, can be similarly realized, when the original image B 110 is considered to comprise all one-color codes.

Further, it is not necessarily required that the resolutions of two sorts of images be the same. For example, in the case where the resolutions of the original image B 110 in horizontal and vertical directions are smaller than those of the original image A 100, when the color codes of the bit map regions of the two images not overlapped with each other are set to be the color data of the original images A 100 and B 110 while the color codes of the overlapped bit map regions of the two images are subjected to the cross fade switching, image switching or the like with use of the above composite image, even that part of the displayed image where the two images are overlapped can be displayed with the two images only by modifying the CLUT.

Figure 5:
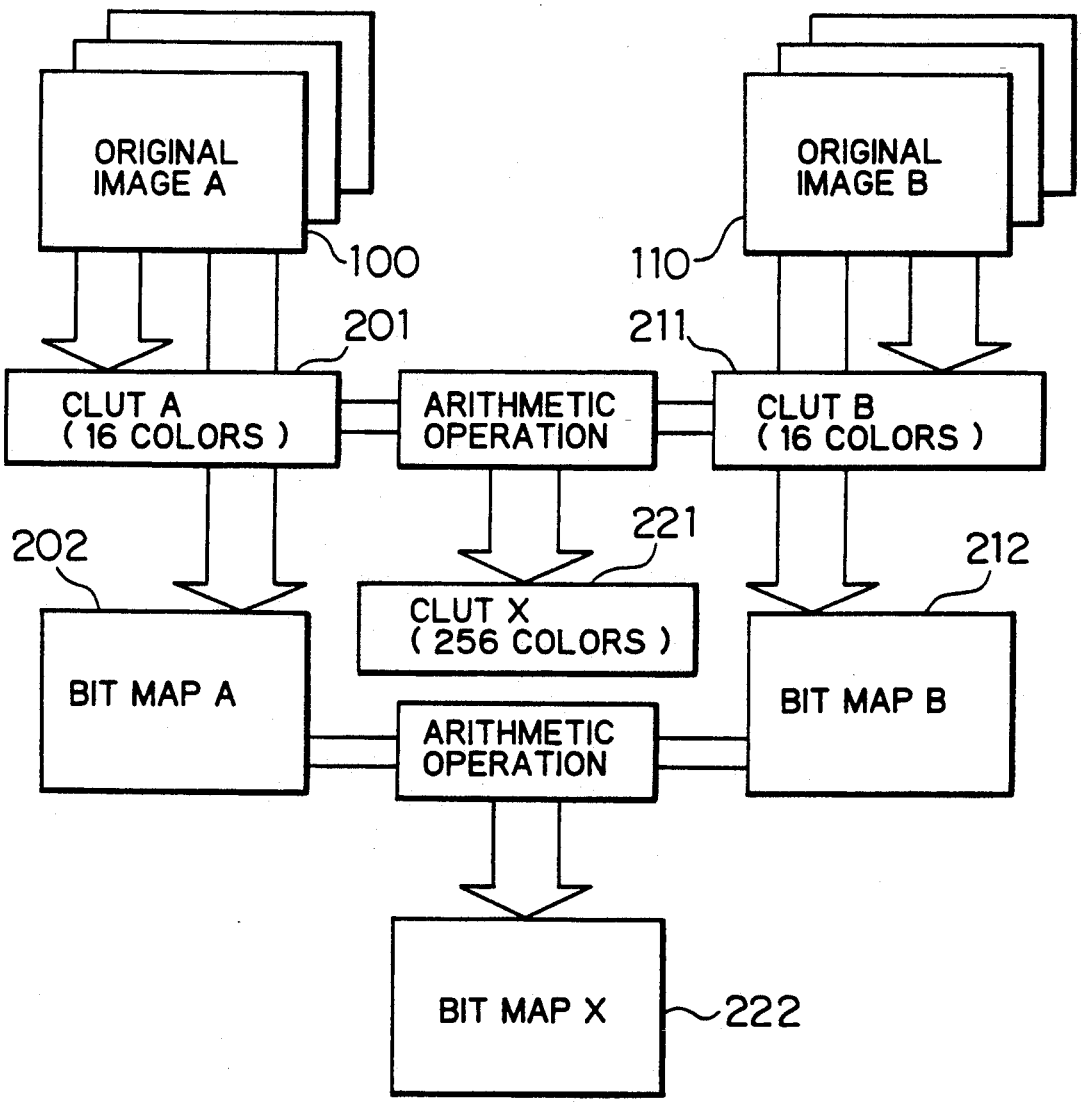
FIG. 5 conceptionally shows a diagram for explaining steps of how to create a composite image from two sorts of independent images according to a color image displaying method of an embodiment of the present invention.

FIG. 5 conceptionally shows steps of how to create a composite image with use of two sorts of independent images according to a color image displaying method of one embodiment of the present invention.

In the drawing, arithmetic operations are carried out by using a PC-compatible computer made by IBM and CLUT X 221 comprises a VGA (Video Graphic Array) display system.

In FIG. 5, the original image A 100 has image data (24 bits in total) of 8 bits per pixel for each of R, G and B while the original image B 110 has image data (24 bits in total) of 8 bits per pixel for each of R, G and B. When it is desired to display the respective images, a combination of a bit map showing a relationship between one pixel and one color code and the CLUT for converting a color code into a color data is used for display. Explanation will be now made in connection with an example where the CLUT has 256 color codes (8-bit color code).

The displayed image of the original image A 100 comprises a CLUT A 201 and a bit map A 202, the pixels of the bit map A 202 correspond to 16 colors from the color code 0 to color code 15. Similarly, the displayed image of the original image B 110 comprises a CLUT B 211 and a bit map B 212, the pixels of the bit map B 212 correspond to 16 colors from the color code 0 to color code 15. Each of the CLUTs uses only 16 of the 256 color codes.

The composite image X 120 is displayed with use of the CLUT X 221 and a bit map X 222. The CLUT X 221 corresponds to a composition of the CLUT A 201 and CLUT B 211 obtained through arithmetic operation based on the principle of FIG. 1, while the bit map X 222 also corresponds to a composition of the bit maps A 202 and B 212 through the arithmetic operation.

In the above method of creating the respective image data, the 16-color CLUTs and the bit map data have been derived from the original images. This method may be realized, for example, by analyzing the color appearance distributions of the original images, selecting 16 of the colors which frequently appear as typical colors to form 16-color CLUTs, then replacing the respective pixels of the original images by the typical colors of the CLUTs closest thereto to form bit maps. However, when the number of colors appearing in such an original image as computer graphics is less than 16, such derivation steps can be eliminated.

The 256-color CLUT X 221 has been formed from the two 16-color CLUTs in the above example. This can be realized by allocating upper 4 of the 8 bits of the color code of the CLUT X 221 to the color codes of the CLUT A 201 and allocating lower 4 thereof to the color codes of the CLUT B 211. Similarly, the respective pixels of the bit map X 222 are created by allocating the color codes of the pixels of the bit maps A 202 and B 212 to upper and lower 4 of the bit map X 222 respectively for color code conversion.

With such an arrangement, it can be easily seen each one of the pixels of the bit map X 222 corresponds to a composite color code of which one of the color codes of the CLUT A 201 and which one of the color codes of the CLUT B 211.

FIGS. 6 and 7 are diagrams for explaining the contents of the CLUTs in FIG. 5. In the following explanation in connection with FIGS. 6 and 7, it is assumed that all the color codes and data are expressed in hexadecimal notation.

In FIGS. 6 and 7, each of the CLUT A 201 and CLUT B 211 has 16 (4 bit) color codes, while the CLUT X 221, which corresponds to a composition of the bit maps A 202 and B 212 according to the principle of FIG. 1, has 256 (8 bit) color codes.

Explanation will then be made as to how to switch an image based on the CLUT modification of the present embodiment in connection with FIGS. 6 and 7.

The color codes of the CLUT A 201 are allocated to upper 4 of the 8 bits of color codes of the CLUT X 221, while the color codes of the CLUT B 211 are allocated to lower 4 of the 8 bits of the CLUT X 221. In FIGS. 6 and 7, for example, the color code 00 of the CLUT X 221 corresponds to a composition of the color code 0 of the CLUT A 201 and the color code 0 of the CLUT B 211, while the color code 10 of the CLUT X 221 corresponds to a composition of the color code 1 of the CLUT A 201 and the color code 0 of the CLUT B 211.

When an actual color data is set based on the CLUT X 221 made according to such a rule as mentioned above, the display of the composite image X 120 can be changed. When it is desired to display the original image A 100, however, the color data of the color code 0 of the CLUT A 201 is set for one of the color codes of the CLUT X 221 having 0 in its upper 4 bits, the color data of the color code 1 of the CLUT A 201 is set for one of the color codes of the CLUT X 221 having 1 in its upper 4 bits, . . . , the color data of the color code F of the CLUT A 201 is set for one of the color codes of the CLUT X 221 having F in its upper 4 bits, and so on, as shown in FIG. 6.

With such an arrangement as stated above, even when each of the pixels of the bit map X 222 for the composite image X 120 has two color codes each having 4 bits, the color data can be determined only by the upper-4-bit color code. As a result, the bit map X 222 of the composite image X 120 can display the original image A 100 itself.

Conversely, when it is desired to display the original image B 110, the color data of the color code 0 of the CLUT B 211 is set for one of the color codes of the CLUT X 221 having 0 in its lower 4 bits, the color data of the color code 1 of the CLUT B 211 is set for one of the color codes of the CLUT X 221 having 1 in its lower 4 bits, . . . , the color data of the color code F of the CLUT B 211 is set for one of the color codes of the CLUT X 221 having F in its lower 4 bits, and so on, as shown in FIG. 7; the bit map X 222 for the composite image X 120 can display the original image B 110 itself as in FIG. 6.

Although the above explanation has been made as to the simultaneous image switching of the two images, cross fade, fade-in and fade-out may be easily realized by weighting the color data of the original two images based on the principle of FIG. 1 to set the CLUT X 221. Further, since each 4 bits in the color code are allocated to a different image, it becomes easy to create a composite image from the original images on a bit basis. As a result, the number of bits is not limited to 4 and any bit number can be employed so long as the original images are allocated on a bit basis with substantially the same effect.

When it is desired to switchingly display two images (i.e., which can be displayed with 10 colors) having 10 color codes for example, color code numbers are arranged in an array of 10×10 and then each 10 colors are allocated to the two images, so that two-image switching can be realized as in the present embodiment. In this case, it is impossible to create a composite image from the original images on a bit basis, but it is possible to create the composite image by judging the color code number belongs to which one of the images, whereby 156 (=256−10×10 colors) of 256 CLUT colors can be used for an image other than the two images.

Figure 8:
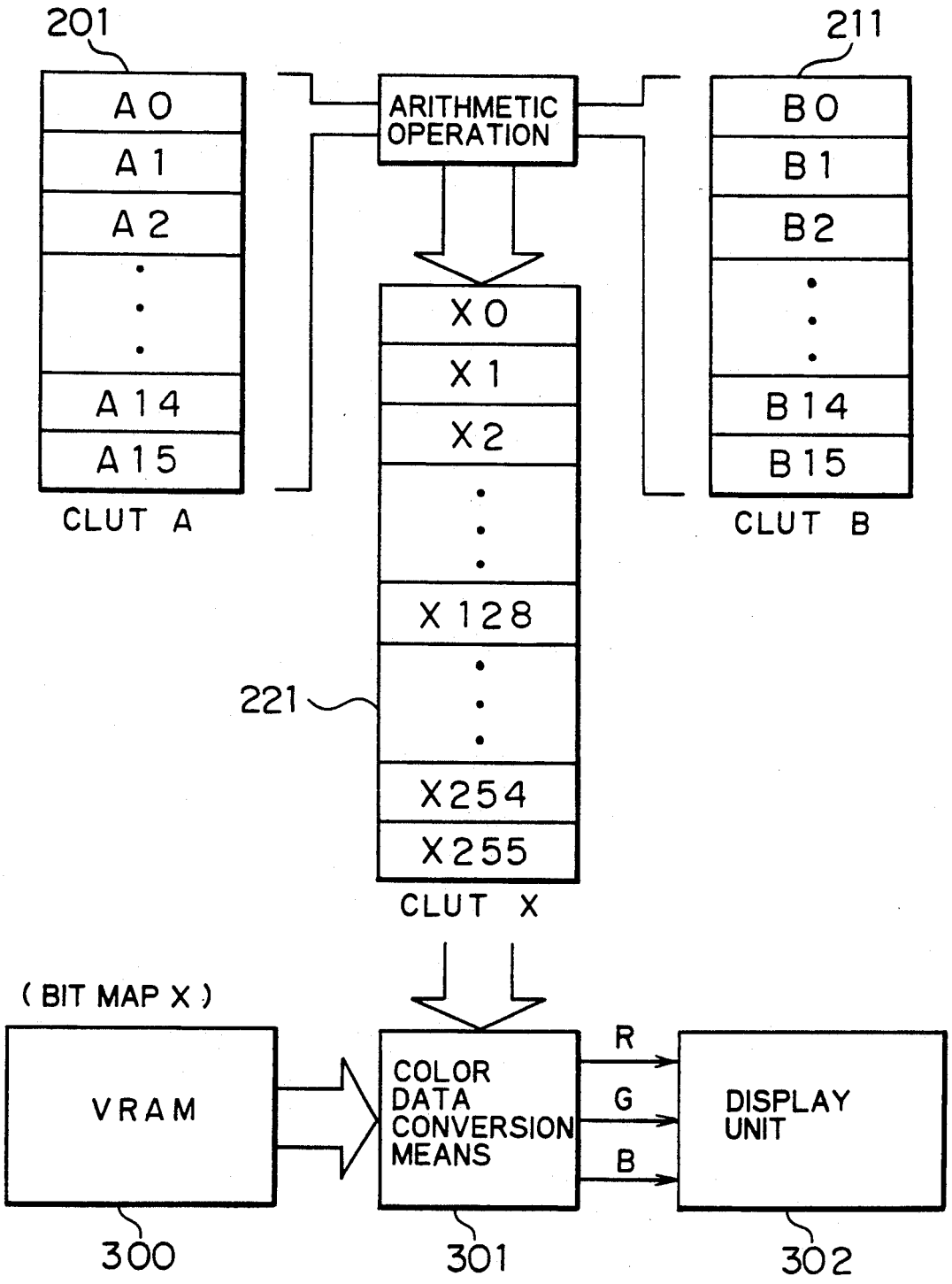
FIG. 8 is a block diagram showing means for creating a composite image from two sorts of independent images according to a color image displaying method of an embodiment of the present invention.

Shown in FIG. 8 is a block diagram for explaining how to create a composite image from two sorts of independent images according to a color image displaying method of another embodiment of the present invention.

In the drawing, reference numeral 300 denotes a VRAM (display memory) for storing therein the bit map X in FIG. 5, numeral 301 denotes a CPU as a color data converting means for converting the color codes of the pixels of the bit map X stored in the VRAM 300 into R, G and B color data on the basis of the CLUT X 221, and 302 denotes a display unit (e.g., CRT) for displaying thereon the composite image based on the R, G and B color data.

A0 to A15 in the CLUT A 201, B0 to B15 in the CLUT B 211, and X0 to X255 in the CLUT X 221 represent the color codes shown in FIGS. 6 and 7.

Explanation will next be made as to how to display two images based on the cross fade switching in connection with an example where cross fade switching is carried out from the original image A 100 to the original image B 110 by referring to FIG. 8.

At the time of starting the display, since it is desired to display the original image A 100, the color data of the color code A0 is set for ones of the color codes of the CLUT X 221 composed from the color code A0 of the CLUT A 201 and similarly, the color data of the color codes A1 to A15 are set for ones of the color codes of the CLUT X 221 using the color codes A1 to A15. In this case, based on FIGS. 6 and 7 at the time of creating the bit maps explained in connection with FIG. 5, it is defined which one of the color codes of the CLUT X 221 uses which one of the color codes of the CLUT A 201. Similarly, based on FIGS. 6 and 7 at the time of creating the bit maps explained in connection with FIG. 5, it is defined with respect to the use of which one of the color codes of the CLUT B 211.

During the cross fade switching operation, depending on the fact that which one of the color codes of the CLUT X 221 corresponds to a combination of which one of the color codes of the CLUT A 201 and which one of the color codes of the CLUT B 211, the color data of the CLUT A 201 and CLUT B 211 are weighted and calculated with the varying time t as a variable, e.g., as shown in FIG. 1 to set the color data of the color codes in the CLUT X 221.

At the time of completing the display, it is desired to display the original image B 110, the color data of the color code B0 is set for one of the color codes of the CLUT X 221 composed from the color code B0 of the CLUT B 211, and similarly, the color data of the color codes B1 to B15 are set for ones of the color codes of the CLUT X 221 using the color codes B1 to B15.

These color data of the CLUT X 221 are applied to the color data converting means 301 so that the 8-bit color codes of the pixels of the bit map X stored in the VRAM 300 are converted in associated with the R, G and B 8 bits of the original images and then outputted to the display unit 302.

In this manner, cross fade display can be realized with respect to the two independent images with use of one color code data.

Figure 9:
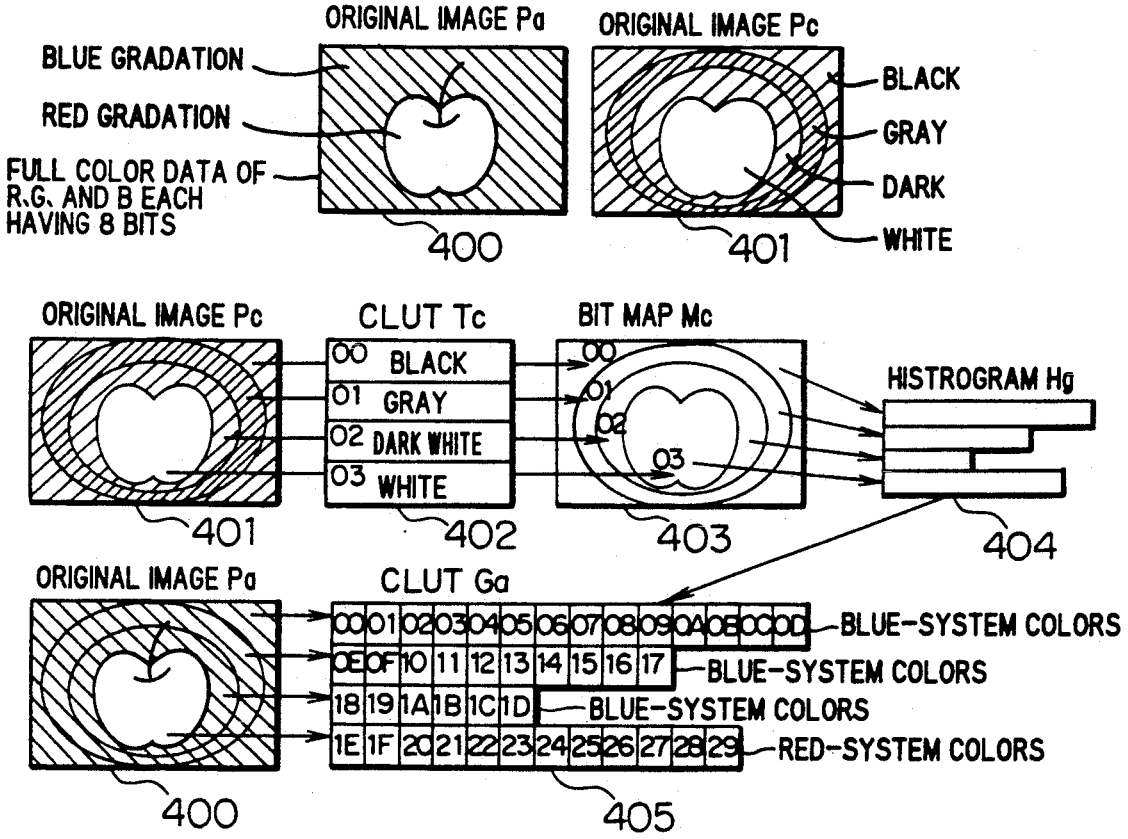
FIG. 9 shows the former half of steps of how to create a composite image from two sorts of independent images according to a color image displaying method of an embodiment of the present invention.
Figure 10:
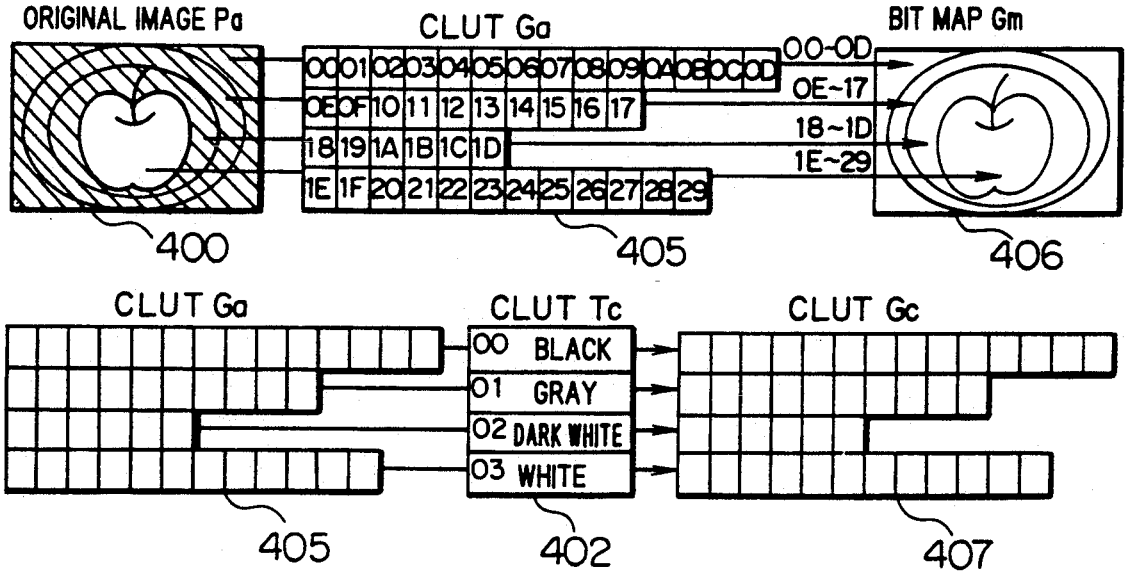
FIG. 10 shows the latter half of the steps of how to create the composite image in FIG. 9.

Referring to FIGS. 9 and 10, there are shown diagrams for explaining the principle of how to create a glowing composite image from two sorts of independent original images according to a color image displaying method of an embodiment of the present invention.

The word 'glow' as used herein refers to a technique for emphasizing part of a display image or to an image effect displaying system for lighting the periphery of an object as if the object were surmounted by an aureole. In the following description, it is assumed that each color code is expressed in hexadecimal notation.

In these drawings, reference numeral 400 denotes an original image Pa with a red apple pattern expressed in terms of R, G and B each having 8 bits.

Numeral 401 denotes an original image Pc in which gradation from black to white takes place from the outside of the image toward the center of the apple pattern.

Numeral 402 denotes a CLUT Tc for displaying the original image Pc 401 with 4 colors.

Numeral 403 denotes a bit map Mc corresponding to the original image Pc 401 but replaced by color codes.

Numeral 404 denotes a histogram showing an appearance frequency distribution with respect to the color codes of the bit map Mc.

Numeral 405 denotes a CLUT Ga for displaying the Pa 400 with 42 colors.

Numeral 406 denotes a bit map Gm corresponding to the original image Pa 400 but replaced by color codes. Numeral 407 denotes a CLUT Gc for displaying the glowing image of the original images Pa 400 and Pc 401 with 42 colors.

Next, how to create a glowing composite image will be explained by referring to FIGS. 9 and 10.

First of all, suppose such a case as to display the original image Pc 401 with only 4 colors (i.e., color quantization). For example, in a three-dimensional color space, the color distribution state of the original image Pc 401 is found, the darkest color (black) and brightest color (white) in the color distributed region are selected, the remaining two colors are determined by selecting colors (gray and dark white) at positions as regular as possible within the color distributed region, whereby the four colors as a limited number of colors are determined (color quantization) is carried out).

Next, the color data (color code 00 for black, color code 01 for gray, color code 02 for dark white, and color code 03 for white) of the selected 4 colors are arranged in a brightness order to form the CLUT Tc 402 while the colors of the pixels of the original image Pc 401 are replaced by the codes closest in color to the color codes of the CLUT Tc 402 to form the bit map Mc 403. For example, if the color of ones of the pixels of the original image Pc 401 is closest to black, then these pixels are replaced by the color codes 00. At this time, an error diffusion technique or a dither technique may be employed for the purpose of increasing the picture quality.

Although explanation has been made in connection with the example where the number of colors of the original image Pc 401 is quantized into 4 and the number of colors of the CLUT Tc 402 is quantized into 4, the number of colors used may be arbitrarily set so long as the number is within the CLUT limit color number range. Further the color quantizing method is also not limited to the illustrated example.

Next, the original image Pa 400 is subjected to 42 colors of color quantization. In the color quantization, the number of sorts in colors to be allocated to the respective color code regions of the bit map Mc 403 at the same display positions as the original image Pa 400 is determined. In determining the number of allocating colors, for example, the histogram Hg 404 having the number of pixels of the bit map Mc 403 is prepared for each of the color code regions, and the number of colors to be allocated to the respective color code regions is determined by the ratio.

In FIGS. 9 and 10, as shown by the CLUT Ga 405, 14 colors are allocated to the color code 00 region, 10 colors are to the color code 01 region, 6 colors are to the color code 02 region, and 12 colors are to the color code 03 region, respectively.

The color data distribution condition of the original image Pa 400 is found for each color code region, color quantization is carried out with the color number shown in the CLUT Ga 405 to prepare such a bit map Gm 406 as shown in FIG. 10. For example, with respect to the color code 00 region, 14 typical colors including a blue-system color (background color) are selected to correspond to the color data of the color codes 00 to 0D of the CLUT Ga 405, and the colors of the pixels of the original image Pa 400 corresponding to the color code 00 region are replaced by the codes closest in color to the the color data of the color codes 00 to 0D of the CLUT Ga 405. In this case, the error diffusion method or a dither method may be employed.

Finally, a glowing CLUT will be created. The CLUT Gc 407 as the glowing CLUT is obtained by adding the color data of the CLUT Tc 402 to the color data of the CLUT Ga 405.

For example, the color data, when they are within a range from the color code 00 to the color code 0D of the CLUT Ga 405, are added to the color data (black) of the color code 00 of the CLUT Tc 402 to form the color data of the color codes 00 to 0D in the glowing CLUT Gc 407. The same holds true for other ranges.

At this time, there are some of the color data of the CLUT which exceed their allowable values, but upper limits for the data may be provided at this time or may be provided at the time of real-time operation during the display of the CLUT to be explained later. Or, the glowing CLUT may be created during the real-time operation.

Though the creation of the CLUT Gc 407 has been realized by adding the color data of the CLUT Tc 402 to the color data of the CLUT Ga 405, such addition may be replaced by subtraction in order to realize such glowing effect as color gets dark or a combination of addition and subtraction may be used as necessary. The glowing composite image can be obtained by the CLUT Gc 407 as the glowing CLUT.

Figure 11:
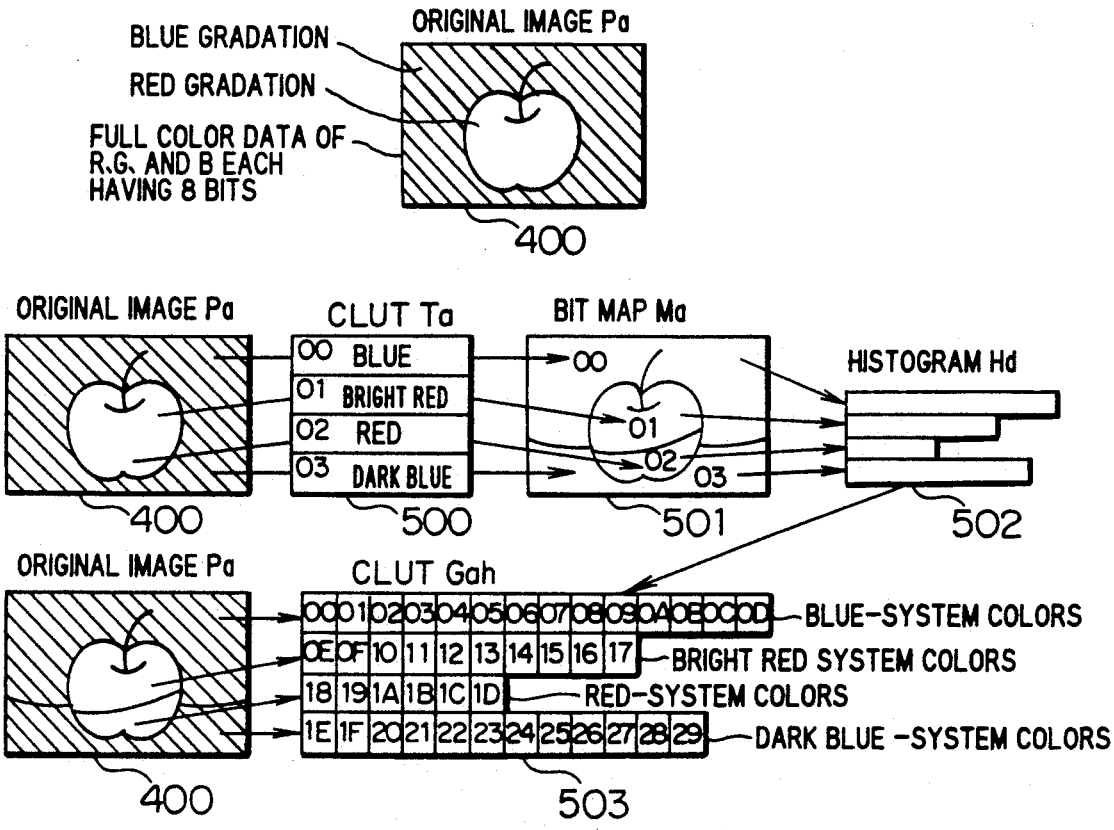
FIG. 11 shows the former half of steps of how to create a composite image in which the color number of the display image stepwise varies according to a color image displaying method of an embodiment of the present invention.
Figure 12:
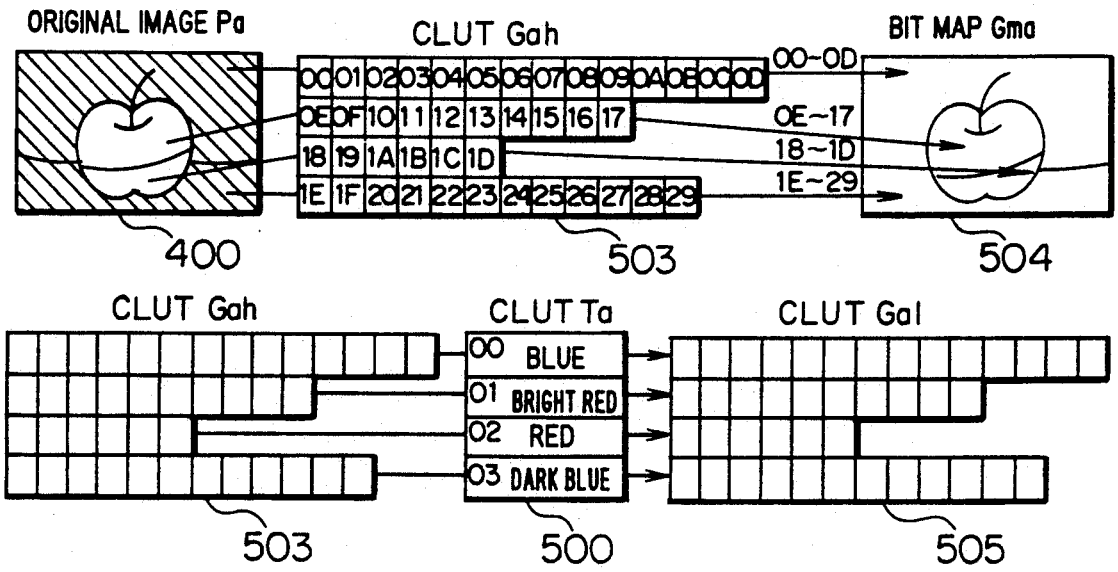
FIG. 12 shows the latter half of the steps of how to create the composite image in FIG. 11.

FIGS. 11 and 12 collectively show, on principle, steps of how to create a composite image in which the number of colors in the display image stepwise varies according to a color image displaying method of an embodiment of the present invention.

Reference numeral 500 denotes a CLUT Ta for displaying the original image Pa 400 with 4 colors.

Numeral 501 denotes a bit map Ma corresponding to the original image Pa 400 but replaced by color codes.

Numeral 502 denotes a histogram Hd for showing an appearance frequency distribution with respect to the color codes of the bit map Ma.

Numeral 503 denotes a CLUT Gah for displaying the original image Pa 400 with 42 colors.

Numeral 504 denotes a bit map Gma corresponding to the original image Pa 400 but replaced by color codes. Numeral 505 denotes a CLUT Gal for displaying the original image Pa 400 with 4 colors.

Explanation will next be made as to how to create a composite image in which the number of colors in the display image stepwise varies by referring to FIGS. 11 and 12.

First of all, the original image Pa 400 is subjected to 4 colors of color quantization. For example, in a three-dimensional color space, the color distribution condition of the original image Pa 400 is found and 4 (blue, bright red, red and dark blue) within the color distributed region frequency used are selected.

Next, the selected 4 color data (00 for blue, 01 for bright red, 02 for red and 03 for dark blue) set as the color data of the CLUT Ta 500, the colors of pixels of the original image Pa 400 are replaced by ones of the color codes of the CLUT Ta 500 closest in color thereto to form the bit map Ma 501.

For example, if one of the pixels of the original image Pa 400 is closest to red, then it is replaced by a code 02. At this time, for the purpose of increasing the image quality, the error diffusion method or dither method may be used. Although explanation has been made in connection with the example where the original image Pa 400 is subjected to 5 colors of color quantization and the CLUT Ta 500 comprises the 4 color data, the number of used colors may be freely set within the CLUT limit color number range. Further, the color quantization can be realized in various ways without any restrictions.

Next, the original image Pa 400 is subjected to 42 colors of color quantization. In the color quantization, the number of sorts in color to be allocated to the color code regions of the bit map Ma 501 at the same display positions as the original image Pa 400 is determined. In determining the number of colors to be allocated, for example, the histogram Hd 502 of the pixel number of the bit map Ma 501 is prepared for each color code region and the number of colors to be allocated is determined by the ratio.

In FIGS. 11 and 12, as shown by the CLUT Gah 503, 14 colors are allocated to the color code 00 region, 10 colors are to the color code 01 region, 6 colors are to the color code 02 region, and 12 colors are to the color code 03 region.

And this time, in a three-dimensional color space of each color code region, the color distribution condition of the original image Pa 400 is found and the original image is subjected to a color quantization with the same color number as the CLUT Gah 503 to form the bit map Gma 504.

For example, with respect to the color code 00 region, 14 typical colors including a blue-system color (background color) are selected and set as the color data of the color codes 00 to 0D of the CLUT Gah 503, while the colors of pixels of the original image Pa 400 corresponding to the color code 00 are replaced by ones of the color data of the color codes 00 to 0D of the CLUT Gah 503 closest in color thereto. In this connection, for the purpose of increasing the image quality, the error diffusion technique or dither technique may be employed.

Finally, a CLUT for 4-color display will be created. The CLUT Gal 505 as the 4-color display CLUT is created by replacing the color codes of the CLUT Gah 503 by the corresponding color data of the CLUT Ta 500. More specifically, the color codes 00 to 0D of the CLUT Ga 503 are all replaced by the color data (red) of the color code 00 of the CLUT Ta 500 to be set as the color data of the color codes 00 to 0D of the CLUT Gal 505 for color number decrease. The same holds true for other ranges.

Figure 13:
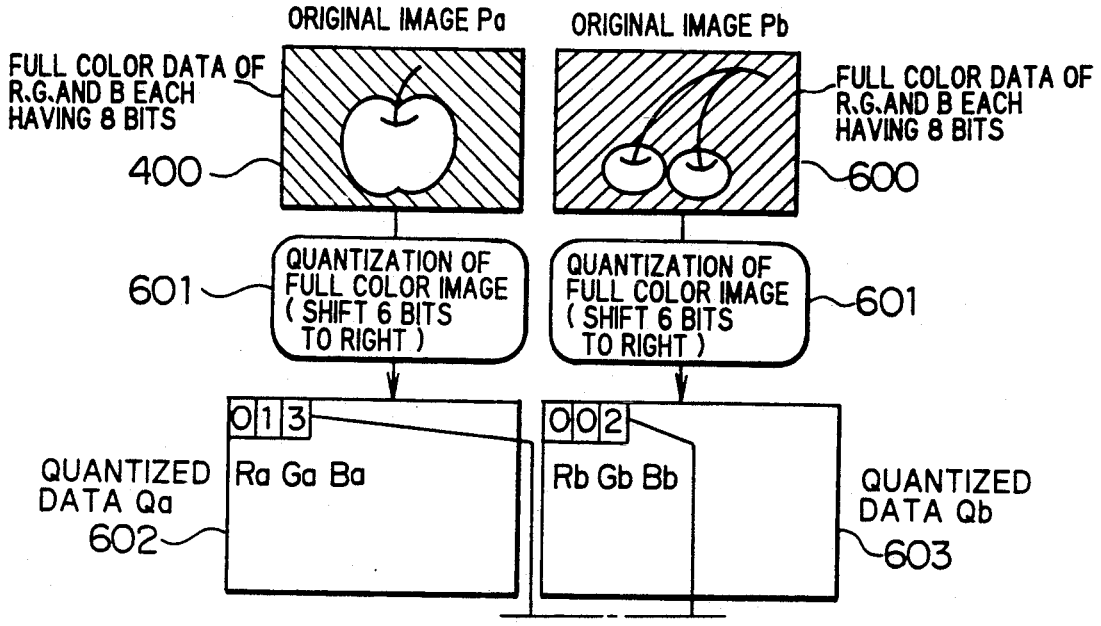
FIG. 13 shows the former half of steps of how to create a cross fade composite image from two sorts of independent images according to a color image displaying method of an embodiment of the present invention.
Figure 14:
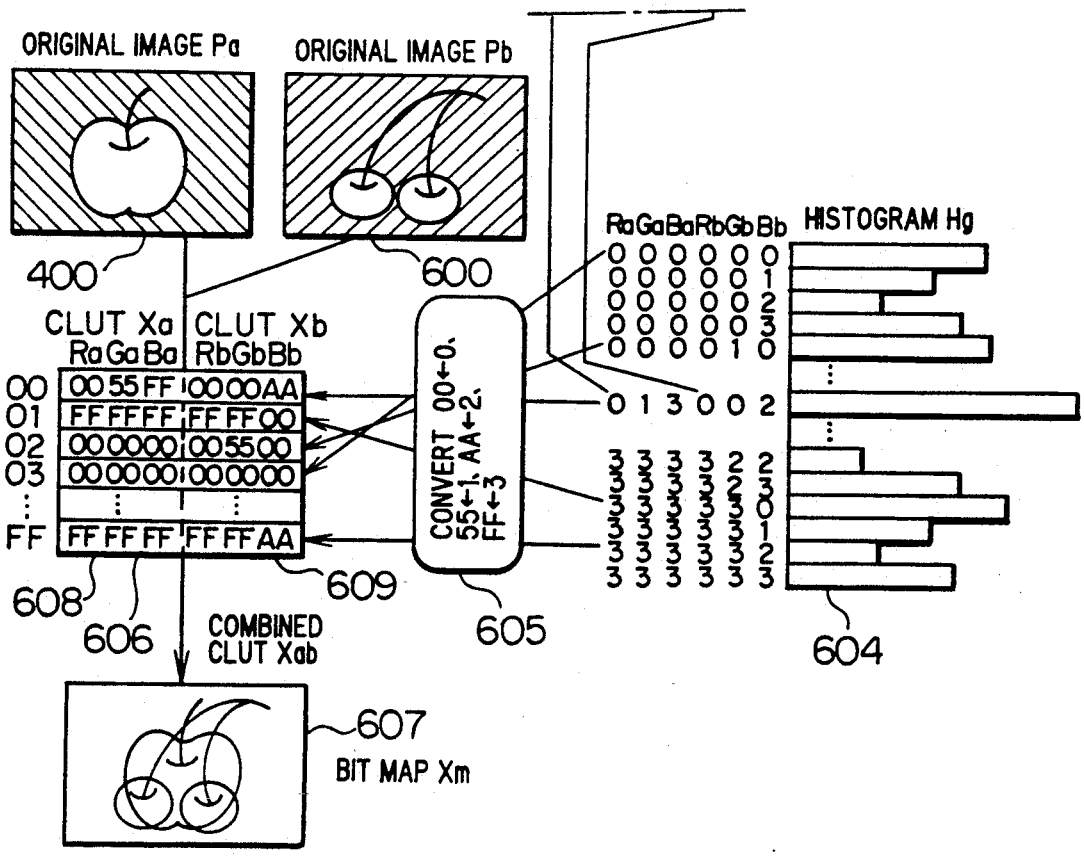
FIG. 14 shows the latter half of the steps of how to create the cross fade composite image from the two sorts of independent images according to the color image displaying method of FIG. 13.

Turning next to FIGS. 13 and 14, these drawings, when combined at a broken-line position to form one drawing, show a diagram for explaining the principle of how to create a composite image for cross fade from two sorts of independent images according to a color image displaying method of an embodiment of the present invention, In these drawings, reference numeral 600 denotes an original image Pb with a cherry pattern with R, G and B each having 8 bits.

Numeral 601 denotes a quantization means for quantizing the original image Pa 400 and the original image Pb 600.

Numeral 602 denotes a quantizing data indicative of the quantized original image Pa 400.

Numeral 603 denotes a quantizing data indicative of the quantized original image Pb 600.

Numeral 604 denotes a histogram Hq indicative of an appearance frequency distribution with respect to the values of the quantized data Qa 602 and Qb 603.

Numeral 605 denotes a conversion means for converting the value of the quantized data into a luminance level. In other words, if the quantized data is 0 then the means 605 converts it into a luminance level 00, if the quantized data is 1 then the means 605 converts it into a luminance level 55, if the quantized data is 2 then the means 605 converts it into a luminance level AA, and if the quantized data is 3 then the means 605 converts it into a luminance level FF.

Numeral 606 denotes a combined CLUT X corresponding to the original images Pa 400 and Pb 600.

Numeral 607 denotes a bit map Xm in which the original images Pa 400 and Pb 600 are simultaneously replace by color codes.

Numeral 608 denotes a partial CLUT Xa used to display the original image Pa 400 out of the combined CLUT Xab 606.

Numeral 609 denotes a partial CLUT Xb used to display the original image Pb 600 out of the combined CLUT Xab 606.

Explanation will then be made as to how to create a cross fade composite image by referring to FIGS. 13 and 14. First preparations will be made for selection of typical colors.

As shown by the quantization means 601, the original image Pa 400 and Pb 600 are quantized to prepare the quantized data Qa 602 and Qb 603.

Although the above quantization has been carried out only by shifting the R, G and B 8-bit original images Pa 400 and Pb 600 by 6 bits rightwards to obtain quantized data, the quantization may be effected freely in various ways. A frequency at which the quantized data Qa 602 and Qb 603 simultaneously appear is taken to prepare the histogram Hg 604.

Next, selection of typical colors is carried out. In the histogram Hg 604, 256 colors are extracted as the combined CLUT Xab 606 in the higher color appearance frequency order. At this time, the quantized data are converted into color data in association with the color data conversion means 301 to be explained later, as shown by the conversion means 605. Though the extraction of typical colors has been carried out depending on the color appearance frequency in the illustrated example, the typical color extraction may be arbitrarily carried out as necessary.

Finally, creation of the bit map Xm 607 will be done. The colors of the pixels of the original images Pa 400 and Pb 600 are replaced by the color codes of the color data of the combined CLUT Xab 606 closest in color thereto to prepare the bit map Xm 607. In this connection, for the purpose of enhancing the image quality, the error diffusion method or dither method may be used.

Figure 15:
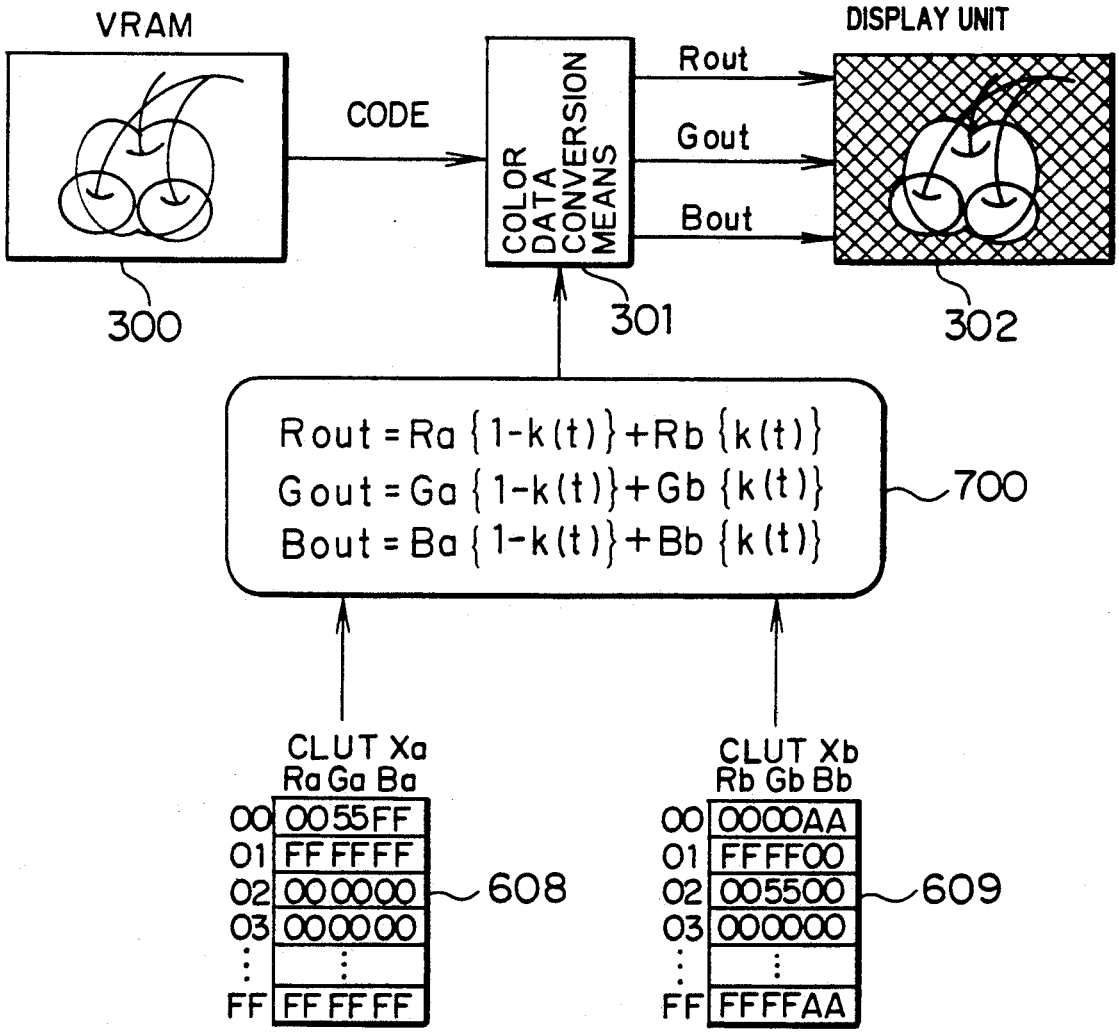
FIG. 15 is a diagram for explaining a method for reproducing an image with use of color-compressed image data prepared in FIGS. 9 to 14.

FIG. 15 is a diagram for explaining how to reproduce an image with use of the color-compressed image data prepared in FIGS. 9 to 14. In FIG. 15, reference numeral 700 denotes arithmetic operation means for perform arithmetic operations over CLUTs.

Explanation will next be made by referring to FIG. 15 as to how to provide an image effect with use of the image data prepared in FIGS. 9 to 14. Explanation will first directed to the cross fade.

For obtaining the cross fade, the bit map Xm 607 prepared in FIGS. 13 and 14 is read in the VRAM 300 in FIG. 15 to perform such arithmetic operations as shown in FIG. 15 over the CLUT Xa 608 and Xb 609 in FIG. 14 and the values of the arithmetic operations are transferred to the color data conversion means 301.

In the arithmetic operation means 700, symbols Rout, Gout and Bout denote the values of the color data to be written into the color data conversion means 301. Symbols Ra, Ga and Ba denote the values of the color data of the codes of the CLUT Xa 608. Symbols Rb, Gb and Bb denote the values of the color data of the codes of the CLUT Xb 609. Symbol k(t) denotes a time function which gradually increases with time from 0 to 1. In this way, an image subjected to the cross fade is reproduced on the display unit 302.

Next explanation will be directed to the glowing. For obtaining the flowing effect, the bit map Gm 406 prepared in FIGS. 9 and 10 is read into the VRAM 300 in FIG. 15, the CLUT Xa 608 is replaced by the CLUT Gc 407 to perform such arithmetic operations as shown in the arithmetic operation means 700, and the resultant values of the arithmetic operations are transferred to the color data conversion means 301.

At this time, if the values of the Rout, Gout and Bout exceeds their predetermined values or overflow, then they are limited to the maximum values of the color data acceptable in the color data conversion means 301. The then Ra, Ga and Ba correspond to the values of the color data of the codes of the CLUT Ga 405. The Rb, Gb and Bb correspond to the values of the color data of the codes of the CLUT Gc 407. The time function k(t) gradually increases with time from 0 to 1 and then gradually decreases from 1 to 0. In this way, an image subjected to the glowing effect is reproduced on the display unit 302.

Finally, explanation will be made as to the step-like color number variation. For obtaining the step-like color number variation effect, the bit map Gma 504 prepared in FIGS. 11 and 12 is read into the VRAM 300 in FIG. 15, the CLUT Gah 503 is used in place of the CLUT Xa 608, the CLUT Gal 505 is used in place of the CLUT Xb 609 to perform such arithmetic operations as shown in the arithmetic operation means 700, and the resultant values of the arithmetic operations are transferred to the color data conversion means 301.

The then Ra, Ga and Ba correspond to the values of the color data of the codes of the CLUT Gah 503. The then Rb, Gb and Bb correspond to the values of the color data of the codes of the CLUT Gal 505. The time function k(t) gradually increases with time from 0 to 1 or gradually decreases from 1 to 0. In this way, an image subjected to the step-like color number variation effect is reproduced on the display unit 302.

Figure 16:
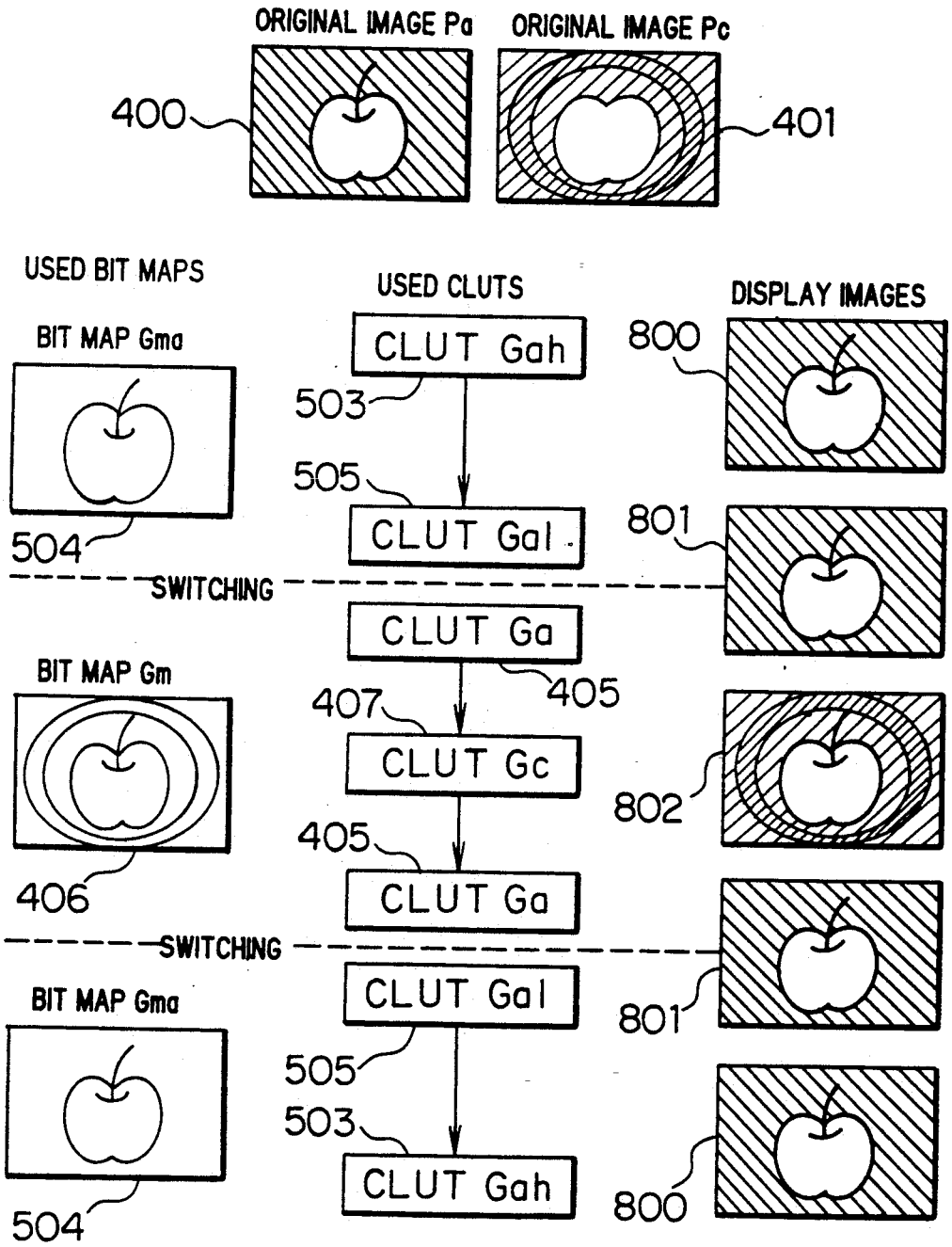
FIG. 16 is a diagram for explaining a method for providing a high quality of glowing display with use of the composite images prepared based on the principle of FIGS. 9 to 12.

FIG. 16 is a diagram for explaining how to provide a high quality of glow display with use of the composite image prepared based on the principle of FIGS. 9 to 12.

In FIG. 16, reference numeral 800 denotes a display image at the stage that the color number variation starts or ends. Numeral 801 denotes a display image at the stage that the glow effect starts or ends. Numeral 802 denotes a display image during glowing period.

First, glowing image data are prepared according to the method shown in FIGS. 9 and 10. Next, image data for causing the color number variation according to the method shown in FIGS. 11 and 12 are prepared, but all the colors used in the CLUT Ga 405 (refer to FIG. 9) are used as the CLUT Ta 500. However, since the same color is registered for a plurality of color codes in the CLUT Ga 405, the number of color codes in the CLUT Ta 500 becomes smaller than the number of color codes in the CLUT Ga 405.

And, color codes in the bit map Ma 501 are selected so that a display image to be displayed based on a combination of the CLUT Ga 405 and the bit map Gm 406 becomes exactly the same as a display image to be displayed based on a combination of the CLUT Ta 500 and the bit map Ma 501. The subsequent operations are substantially the same as those already explained in connection with FIGS. 11 and 12.

Finally, explanation will be directed to control of the image data. For the purpose of minimizing the color number stepwise to adjust the image quality, in FIG. 15, the bit map Gma 504 is read into the VRAM 300, the CLUT Gah 503 is used in place of the CLUT Xa 608, the CLUT Gal 505 is used in place of the CLUT Xb 609. The time function k(t) gradually varies from 0 to 1 to perform such arithmetic operations as shown in the arithmetic operation means 700 and the resultant values of the arithmetic operations are continuously transferred to the color data conversion means 301.

When the time function t(k) arrives at 1, for providing the glowing effect, the contents of the VRAM 300 are instantaneously switched to the bit map Gm 406, the CLUT Ga 405 is used in place of the CLUT Xa 608, and the CLUT Gc 407 is used in place of the CLUT Xb 609.

The time function k(t) is gradually varied from 0 to 1 or from 1 to 0 to perform such arithmetic operations as shown in the arithmetic operation means 700 and the resultant values of the arithmetic operations are continuously transferred to the color data conversion means 301. At this time, if the values of the Rout, Gout and Bout overflow, then they are limited to the maximum limit values of the color data acceptable in the color data conversion means 301.

When the time function k(t) returns to 0, in order to increase the color number stepwise to adjust the image quality, the contents of the VRAM 300 are instantaneously switched to the bit map Gma 504, the CLUT Gah 503 is used in place of the CLUT Xa 608, the CLUT Gal 505 is used in place of the CLUT Xb 609, the time function k(t) is gradually varied from 1 to 0 to perform such arithmetic operations as shown in the arithmetic operation means 700, and the resultant values of the arithmetic operations are continuously transferred to the color data conversion means 301.

When such control as mentioned above is applied, high qualities of smooth glowing displays can be obtain as shown by the display images 801, 802 and 803 in FIG. 16.

Figure 17:
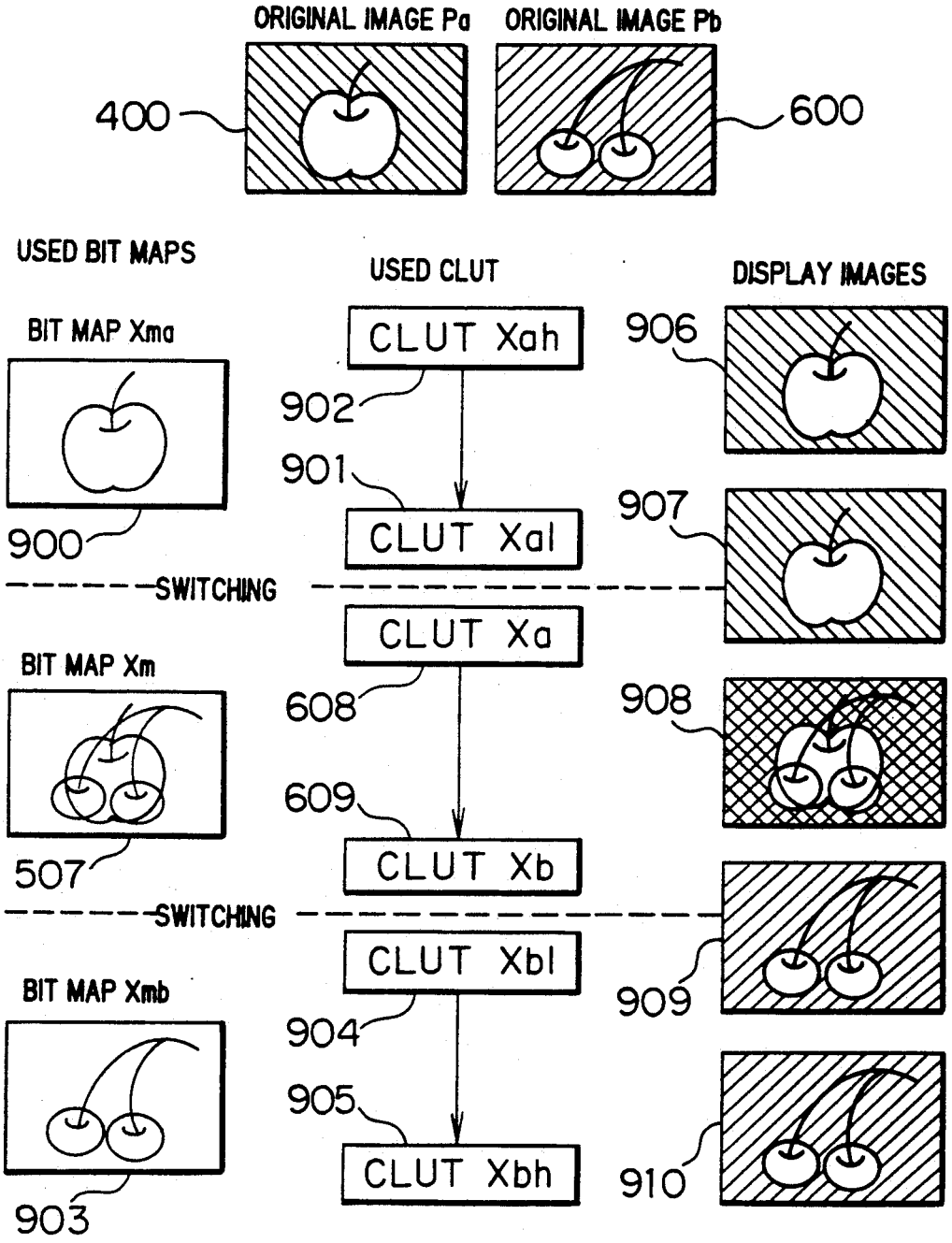
FIG. 17 is a diagram for explaining a method for providing a high quality of cross fade display with use of the composite images prepared based on the principle of FIGS. 13 and 14 and FIGS. 11 and 12.

FIG. 17 is a diagram for explaining how to provide a high quality of cross fade display with use of the composite image prepared based on the principles of FIGS. 13 and 14 and FIGS. 11 and 12.

In FIG. 17, reference numeral 900 denotes a bit map Xma for displaying a pattern in the original image Pa 400 and corresponds to the bit map Gma 504 (refer to FIG. 12).

Numeral 901 denotes a CLUT Xal made up of the same colors as the CLUT Xa 608 (refer to FIG. 14) and correspond to the CLUT Gal 505 (refer to FIG. 12).

Numeral 902 denotes a CLUT Xah made up of colors larger in number than the CLUT Xal 901 and corresponds to the CLUT Gah 503.

Numeral 903 denotes a bit map Xmb for displaying a pattern in the original image Pb 600 and corresponds to the bit map Gma 504.

Numeral 904 denotes a CLUT Xb1 made up of the same colors as the CLUT Xb 609 and corresponds to the CLUT Gal 505.

Numeral 905 denotes a CLUT Xbh made up of colors larger in number than the CLUT Xb1 901 and corresponds to the CLUT Gah 503.

Numeral 906 is a display image when the color number variation starts.

Numeral 907 is a display image when the cross fade starts.

Numeral 908 is a display image during the cross fade operation.

Numeral 909 is a display image when the cross fade ends.

Numeral 910 is a display image when the color number variation ends.

First of all, an image data for cross fade is prepared according to the method of FIGS. 13 and 14. Then, image data for causing the color number variation are prepared according to the method of FIGS. 11 and 12. However, for the original image Pa 400, all the colors used in the CLUT Xa 608 are used as the CLUT Ta 500. Since the same color is registered for a plurality of color codes in the CLUT Xa 608, however, the number of color codes in the CLUT Ta 500 becomes smaller than the number of color codes in the CLUT Xa 608.

Color codes in the bit map Ma 501 are selected so that a display image to be displayed based on a combination of the CLUT Xa 608 and the bit map Xm 507 becomes exactly the same as a display image to be displayed based on a combination of the CLUT Ta 500 and the bit map Na 501. The subsequent operations are substantially the same as those already explained in connection with FIGS. 11 and 12.

Similarly, for the original image Pb 600, all the colors used in the CLUT Xb 609 are used as the CLUT Ta 500. And color codes in the bit map Ma 501 are selected so that a display image to be displayed based on a combination of the CLUT Xb 609 and the bit map Xm 507 becomes exactly the same as a display image to be displayed based on a combination of the CLUT Ta 500 and the bit map Na 501. The subsequent operations are substantially the same as those already explained in connection with FIGS. 11 and 12.

Finally, explanation will be directed to control of the image data. For the purpose of minimizing the color number stepwise to adjust the image quality, in FIG. 15, the bit map Gma 504 is read into the VRAM 300, the CLUT Xah 902 is used in place of the CLUT Xa 608, and the CLUT Xal 901 is used in place of the CLUT Xb 609.

The time function k(t) gradually varies from 0 to 1 to perform such arithmetic operations as shown in the arithmetic operation means 700 and the resultant values of the arithmetic operations are continuously transferred to the color data conversion means 301. When the time function t(k) arrives at 1, for providing the cross fade effect, the contents of the VRAM 300 are instantaneously switched to the bit map Xm 507, the CLUTs Xa 405 and Xb 608 are used, the time function k(t) is gradually varied from 0 to 1 to perform such arithmetic operations as shown in the arithmetic operation means 700, and the resultant values of the arithmetic operations are continuously transferred to the color data conversion means 301.

When the time function k(t) arrives at 1, in order to increase the number of colors stepwise to adjust the image quality, the contents of the VRAM 300 are instantaneously switched to the bit map Xmb 903, the CLUT Xbh 905 is used in place of the CLUT Xa 608, the CLUT Xb1 904 is used in place of the CLUT Xb 609, the time function k(t) is gradually varied from 1 to 0 to perform such arithmetic operations as shown in the arithmetic operation means 700, and the resultant values of the arithmetic operations are continuously transferred to the color data conversion means 301.

When such control as mentioned above is applied, high qualities of smooth cross fade displays can be realized as shown by the display images 906 to 910 in FIG. 17.

In the foregoing embodiments, it is clear that the present invention can be applied to such a case where the number of colors for the CLUT data is limited to an arbitrary value. Although the number of different sorts of images has been set to be 2 in the foregoing embodiments, the number of image sorts is not necessarily limited to 2, and so long as a color number to be applied to one sort of image is more than 1 and a produce of the color numbers allocated to these images is less than the number of colors in the CLUT, substantially the same effects as the present invention can be obtained.

As already explained in connection with FIG. 1 showing the principle, such image effects as cross fade, fade-in, fade-out and glow in the present invention is valid not only for the entire display image but also for, e.g., a partial window of a multi-window display.

Although the foregoing explanation has been made as to the display unit using one CLUT, such a display unit as to use CLUTs respectively independently for the R, G and B colors may be provided so that a composite image from the a plurality of images according to the present invention is created for each display plane of the R. G and B, and a composite CLUT according to the present invention is prepared for each of the R, G and B CLUTs. As a result, the invention has such an effect that a plurality of images can be displayed only by modifying the respective R, G and B CLUTs.

As has been disclosed in the foregoing, in accordance with the present invention, such image effects as cross fade switching, fade-in, fade-out, and glowing can be advantageously realized in images larger in number than the images storable in the VRAM, while preventing the increase of the display memory capacity and circuit size.

A Japanese Patent Application Hei 3-276159 filed Sep. 30, 1991 is hereby incorporated herein by reference.

The present invention has been described in detail, it should be understood that various changes, substitutions and alternations can be made thereto without departing from the spirit and scope of the present invention as defined by the appended claims.

What is claimed is:

1. A color image displaying method with use of bit maps each made up of color codes corresponding to pixels of an image and color look up tables for associating color data with the color codes as the pixels of the bit maps, said method comprising the steps of:

preparing said bit maps and color look up tables corresponding in number to a plurality of images;

composing composite color codes associated with pixels of a composite image and color codes obtained from said plurality of prepared bit maps and associated with pixels at the same positions as said pixels to obtain a composite bit map made up of said composite color codes;

preparing composite color data associated with the composite color codes as the elements of the composite bit map on the basis of the color data associated with said color codes obtained from said plurality of color look up tables and composed to prepare said composite color codes;

preparing a composite color look up table for associating said composite color data with the composite color codes as the elements of the said composite bit map; and displaying said composite image with use of said composite bit map and said composite color look up table, wherein first one of said plurality of bit maps and first one of said plurality of color look up tables corresponding in number to said plurality of images are used to display first one of the plurality of images, second one of said plurality of bit maps and second one of said plurality of color look up tables corresponding in number to said plurality of images are used to display second one of the images, said composite color data prepared based on said color data obtained from said plurality of color look up tables are composed with said color data obtained from said first color look up table and with said color data obtained from said second color look up table to obtain composite data obtained at a predetermined ratio therebetween and to thereby obtain said composite image to be displayed and corresponding an overlapped image between said first and second images.

2. A color image displaying method as set forth in claim 1, wherein said composite color data prepared on the basis of said color data obtained from said plurality of color look up tables are composed with said color data obtained from said first color look up table and with said color data obtained from said second color look up table at a predetermined ratio therebetween to form composite data, and said ratio is stepwise varied with time to switch said composite image to be displayed from said first image to said second image in a cross fade manner.

3. A color image displaying method with use of bit maps each made up of color codes corresponding to pixels of an image and color look up tables for associating color data with the color codes as the pixels of the bit maps, said method comprising the steps of:

preparing said bit maps and color look up tables corresponding in number to a plurality of images;

composing composite color codes associated with pixels of a composite image and color codes obtained from said plurality of prepared bit maps and associated with pixels at the same positions as said pixels to obtain a composite bit map made up of said composite color codes;

preparing composite color data associated with the composite color codes as the elements of the composite bit map on the basis of the color data associated with said color codes obtained from said plurality of color look up tables and composed to prepare said composite color codes;

preparing a composite color look up table for associating said composite color data with the composite color codes as the elements of the said composite bit map; and displaying said composite image with use of said composite bit map and said composite color look up table, wherein first one of said plurality of bit maps and first one of said plurality of color look up tables corresponding in number to said plurality of images are used to display first one of the plurality of images, second one of said plurality of bit maps and second one of said plurality of color look up tables corresponding in number to said plurality of images are used to display second one of the images, said composite color data prepared based on said color data obtained from said plurality of color look up tables are instantaneously switched from the color data obtained from said first color look up table to said color data obtained from said second color look up table to switch said composite image to be displayed from said first image to said second image.

4. A color image displaying method with use of bit maps each made up of color codes corresponding to pixels of an image and color look up tables for associating color data with the color codes as the pixels of the bit maps, said method comprising the steps of:

preparing said bit maps and color look up tables corresponding in number to a plurality of images;

composing composite color codes associated with pixels of a composite image and color codes obtained from said plurality of prepared bit maps and associated with pixels at the same positions as said pixels to obtain a composite bit map made up of said composite color codes;

preparing composite color data associated with the composite color codes as the elements of the composite bit map on the basis of the color data associated with said color codes obtained from said plurality of color look up tables and composed to prepare said composite color codes;

preparing a composite color look up table for associating said composite color data with the composite color codes as the elements of the said composite bit map; and displaying said composite image with use of said composite bit map and said composite color look up table, wherein first one of said plurality of bit maps is used to display first one of said plurality of images, second one of said plurality of bit maps is used to display second one of said plurality of images, said composite color data prepared on the basis of said color data obtained from said plurality of color look up tables are obtained by adding the color data obtained from said first look up table and the color data obtained from said second look up table, and an image to be displayed through said composite bit map prepared on the basis of said first and second color look up tables is a composite image corresponding to a sum of said first and second images.

5. A color image displaying method as set forth in claim 4, wherein the color data obtained from said second color look up table is added to the color data obtained from said first color look up table at a predetermined ratio which stepwise varies with time to gradually vary said composite image.

6. A color image displaying method with use of bit maps each made up of color codes corresponding to pixels of an image and color look up tables for associating color data with the color codes as the pixels of the bit maps, said method comprising the steps of:

preparing said bit maps and color look up tables corresponding in number to a plurality of images;

composing composite color codes associated with pixels of a composite image and color codes obtained from said plurality of prepared bit maps and associated with pixels at the same positions as said pixels to obtain a composite bit map made up of said composite color codes;

preparing composite color data associated with the composite color codes as the elements of the composite bit map on the basis of the color data associated with said color codes obtained from said plurality of color look up tables and composed to prepare said composite color codes;

preparing a composite color look up table for associating said composite color data with the composite color codes as the elements of the said composite bit map; and displaying said composite image with use of said composite bit map and said composite color look up table, wherein first one of said plurality of bit maps and first one of said plurality of color look up tables corresponding in number to said plurality of images are used to display first one of the plurality of images, second one of said plurality of bit maps and second one of said plurality of color look up tables corresponding in number to said plurality of images are used to display second one of the images, said first and second images have the same pattern as the original image but first color data used in said first color look up table are different in number of color data from second color data used in said second color look up table to display said first and second images in different color conditions, the composite color data prepared on the basis of said color data obtained from said plurality of color look up tables are obtained by composing the first color data obtained from said first color look up table and the second color data obtained from said second color look up table, an image to be displayed is obtained by overlapping said first image with said second image different in color condition from said first image.

7. A color image displaying method as set forth in claim 6, wherein said first color data are composed with said second color data at a predetermined ratio therebetween which stepwise varies with time to gradually change an image to be displayed from said first image to said second image.

8. A color image displaying method as set forth in claim 1, wherein the number of color data associated with color data in said color look up table is the power of 2 ($2^n$) and the number of color data associated with color data in said composite color look up table is also the power of 2 ($2^n$).

9. A color image displaying method as set forth in claim 3, wherein the number of color data associated with color data in said color look up table is the power of 2 ($2^n$) and the number of color data associated with color data in said composite color look up table is also the power of 2 ($2^n$).

10. A color image displaying method as set forth in claim 4, wherein the number of color data associated with color data in said color look up table is the power of 2 ($2^n$) and the number of color data associated with color data in said composite color look up table is also the power of 2 ($2^n$).

11. A color image displaying method as set forth in claim 6, wherein the number of color data associated with color data in said color look up table is the power of 2 ($2^n$) and the number of color data associated with color data in said composite color look up table is also the power of 2 ($2^n$).

12. A color image displaying method as set forth in claim 1, wherein the composite color look up table having color dimensions corresponding in number to a plurality of images is prepared for a plurality of image data corresponding in number to said plurality of images, said composite color codes are obtained by selecting ones of the color codes closest in color to the pixels at the same positions in said plurality of image data to form said composite bit map made up of said composite color codes, and said composite image is displayed with use of said composite bit map and said composite color look up table.

13. A color image displaying method as set forth in claim 3, wherein the composite color look up table having color dimensions corresponding in number to a plurality of images is prepared for a plurality of image data corresponding in number to said plurality of images, said composite color codes are obtained by selecting ones of the color codes closest in color to the pixels at the same positions in said plurality of image data to form said composite bit map made up of said composite color codes, and said composite image is displayed with use of said composite bit map and said composite color look up table.

14. A color image displaying method as set forth in claim 4, wherein the composite color look up table having color dimensions corresponding in number to a plurality of images is prepared for a plurality of image data corresponding in number to said plurality of images, said composite color codes are obtained by selecting ones of the color codes closest in color to the pixels at the same positions in said plurality of image data to form said composite bit map made up of said composite color codes, and said composite image is displayed with use of said composite bit map and said composite color look up table.

15. A color image displaying method as set forth in claim 6, wherein the composite color look up table having color dimensions corresponding in number to a plurality of images is prepared for a plurality of image data corresponding in number to said plurality of images, said composite color codes are obtained by selecting ones of the color codes closest in color to the pixels at the same positions in said plurality of image data to form said composite bit map made up of said composite color codes, and said composite image is displayed with use of said composite bit map and said composite color look up table.

16. A color image displaying method with use of bit maps each made up of color codes corresponding to pixels of an image and color look up tables for associating color data with the color codes as the pixels of the bit maps, said method comprising the steps of:

preparing said bit maps and color look up tables corresponding in number to a plurality of images;

composing composite color codes associated with pixels of a composite image and color codes obtained from said plurality of prepared bit maps and associated with pixels at the same positions as said pixels to obtain a composite bit map made up of said composite color codes;

preparing composite color data associated with the composite color codes as the elements of the composite bit map on the basis of the color data associated with said color codes obtained from said plurality of color look up tables and composed to prepare said composite color codes;

preparing a composite color look up table for associating said composite color data with the composite color codes as the elements of the said composite bit map; and displaying said composite image with use of said composite bit map and said composite color look up table, wherein first one of said plurality of bit maps and first one of said plurality of color look up tables corresponding in number to said plurality of images are used to display first one of the plurality of images, second one of said plurality of bit maps and second one of said plurality of color look up tables corresponding in number to said plurality of images are used to display second one of the images, said second color look up table and second bit map associated with said second image is prepared from said second image data of c color (where c is a natural number smaller than the limited number of colors in the color look up table), said first image data are divided into c of regions through said bit map to find typical colors in each of said regions, said first color look up table made up of said typical colors is prepared, said first color look up table is used to prepare said first bit map from said first image data, and said first bit map is used as the composite bit map for image display.

17. A color image displaying method as set forth in claim 16, wherein said composite color data prepared on the basis of said color data obtained from said plurality of color look up tables are obtained by adding the color data obtained from said first look up table and the color data obtained from said second look up table at a predetermined ratio therebetween, and said ratio is stepwise varied with time to gradually change an image to be displayed through said composite bit map prepared on the basis of said first and second color look up tables from said first image to said composite image corresponding to a sum of said first and second images.

18. A color image displaying method as set forth in claim 16, wherein said first and second images have the same pattern as the original image but first color data used in said first color look up table are different in color number from second color data used in said second color look up table to display said first and second images in different color conditions, the composite color data prepared on the basis of said color data obtained from said plurality of color look up tables are obtained by composing the first color data obtained from said first color look up table and the second color data obtained from said second color look up table, said ratio is stepwise varied with time to change the composite color data from said first color data to said second color data through mixture data therebetween, and an image to be displayed is gradually changed from said first image to said second image different in color condition from said first image.

19. A color image displaying method as set forth in claim 2, wherein said first and second images have the same pattern as the original image but first color data used in said first color look up table are different in number of color data from second color data used in said second color look up table to display said first and second images in different color conditions, the composite color data prepared on the basis of said color data obtained from said plurality of color look up tables are obtained by composing the first color data obtained from said first color look up table and the second color data obtained from said second color look up table, said ratio is stepwise varied with time to change the composite color data from said first color data to said second color data through mixture data therebetween, and an image to be displayed is gradually changed from said first image to said second image different in color condition from said first image.

20. A color image displaying method as set forth in claim 5, wherein said first and second images have the same pattern as the original image but first color data used in said first color look up table are different in number of color data from second color data used in said second color look up table to display said first and second images in different color conditions, the composite color data prepared on the basis of said color data obtained from said plurality of color look up tables are obtained by composing the first color data obtained from said first color look up table and the second color data obtained from said second color look up table, said ratio is stepwise varied with time to change the composite color data from said first color data to said second color data through mixture data therebetween, and an image to be displayed is gradually changed from said first image to said second image different in color condition from said first image.

21. A color image displaying method as set forth in claim 1, wherein said composite bit map and composite color look up table to be used to display said composite image include a red composite color look up table and a red composite color look up table to be used to display a red composite image, a green composite color look up table and a green composite color look up table to be used to display a green composite image, and a blue composite color look up table and a blue composite color look up table to be used to display a blue composite image.

22. A color image displaying method as set forth in claim 3, wherein said composite bit map and composite color look up table to be used to display said composite image include a red composite color look up table and a red composite color look up table to be used to display a red composite image, a green composite color look up table and a green composite color look up table to be used to display a green composite image, and a blue composite color look up table and a blue composite color look up table to be used to display a blue composite image.

23. A color image displaying method as set forth in claim 4, wherein said composite bit map and composite color look up table to be used to display said composite image include a red composite color look up table and a red composite color look up table to be used to display a red composite image, a green composite color look up table and a green composite color look up table to be used to display a green composite image, and a blue composite color look up table and a blue composite color look up table to be used to display a blue composite image.

24. A color image displaying method as set forth in claim 6, wherein said composite bit map and composite color look up table to be used to display said composite image include a red composite color look up table and a red composite color look up table to be used to display a red composite image, a green composite color look up table and a green composite color look up table to be used to display a green composite image, and a blue composite color look up table and a blue composite color look up table to be used to display a blue composite image.

25. A color image displaying method as set forth in claim 16, wherein said composite bit map and composite color look up table to be used to display said composite image include a red composite color look up table and a red composite color look up table to be used to display a red composite image, a green composite color look up table and a green composite color look up table to be used to display a green composite image, and a blue composite color look up table and a blue composite color look up table to be used to display a blue composite image.

26. A color image displaying system having bit maps each made up of color codes corresponding to pixels of an image and color look up tables for associating color data with the color codes as the pixels of the bit maps, said system comprising:

means for composing composite color codes associated with pixels of a composite image and color codes obtained from said plurality of prepared bitmaps and associated with pixels at the same positions as said pixels to obtain a composite bit map made up of said composite color codes;

means for preparing composite color data associated with the composite color codes as the elements of the composite bit map on the basis of the color data associated with said color codes obtained from said plurality of color look up tables and composed to prepare said composite color codes;

means for preparing a composite color look up table for associating said composite color data with the composite color codes as the elements of the said composite bit map; and means for displaying said composite image with use of said composite bit map and said composite color look up table, wherein first one of said plurality of bit maps and first one of said plurality of color look up tables corresponding in number to said plurality of images are used to display first one of the plurality of images, second one of said plurality of bit maps and second one of said plurality of color look up tables corresponding in number to said plurality of images are used to display second one of the images, said composite color data prepared based on said color data obtained from said plurality of color look up tables are composed with said color data obtained from said first color look up table and with said color data obtained from said second color look up table to obtain composite data obtained at a predetermined ratio therebetween and to thereby obtain said composite image to be displayed and corresponding an overlapped image between said first and second images.

* * * * *